US006564434B1

(12) United States Patent
Morita

(10) Patent No.: US 6,564,434 B1
(45) Date of Patent: May 20, 2003

(54) MAGNETIC FIXING UNIT

(76) Inventor: Tamao Morita, 47-1, Arakawa, 6-Chome, Arakawa-ku, Tokyo 116 (JP)

( * ) Notice: Subject to any disclaimer, the term of this patent is extended or adjusted under 35 U.S.C. 154(b) by 0 days.

(21) Appl. No.: 09/652,017

(22) Filed: Aug. 31, 2000

(51) Int. Cl.[7] ..... A44C 5/00; A44C 21/00

(52) U.S. Cl. ..... 24/303; 24/66.1; 24/114.2; 292/251.5

(58) Field of Search ..... 24/303, 66.1, 114.2, 24/658, 683, 684, 689; 292/251.5

(56) References Cited

U.S. PATENT DOCUMENTS 4,700,436 A 10/1987 Morita
4,924,559 A * 5/1990 Marchesi ..... 24/303
4,453,294 A 5/1991 Morita
5,125,134 A 6/1992 Morita
5,152,035 A 10/1992 Morita
5,199,138 A 4/1993 Morita
5,253,394 A 10/1993 Morita
5,274,889 A 1/1994 Morita
5,377,392 A 1/1995 Morita
5,572,887 A * 11/1996 Geswelli ..... 63/3
5,707,091 A 1/1998 Morita
5,920,966 A * 7/1999 Chen ..... 24/303
5,933,926 A * 8/1999 Reiter ..... 24/303
5,937,487 A * 8/1999 Bauer ..... 24/303
6,009,601 A * 1/2000 Kaufman ..... 24/303
6,131,247 A 10/2000 Morita
6,182,336 B1 * 2/2001 Bauer ..... 24/303
6,215,381 B1 * 4/2001 Aoki ..... 335/207
6,295,702 B1 * 10/2001 Bauer ..... 24/303

* cited by examiner

*Primary Examiner*—Robert J. Sandy
*Assistant Examiner*—Andre' Jackson
(74) *Attorney, Agent, or Firm*—Patton Boggs LLP

(57) ABSTRACT

A magnetic fixing unit having a first and second sub-assembly with cooperative structure for increased strength of assembly and prevention of mutual shifting between the first and the second assemblies. The magnetic fixing unit further includes a guide structure on one of the first and second assemblies to effect cooperative locking engagement with an engaging member on the other of the assemblies.

4 Claims, 11 Drawing Sheets

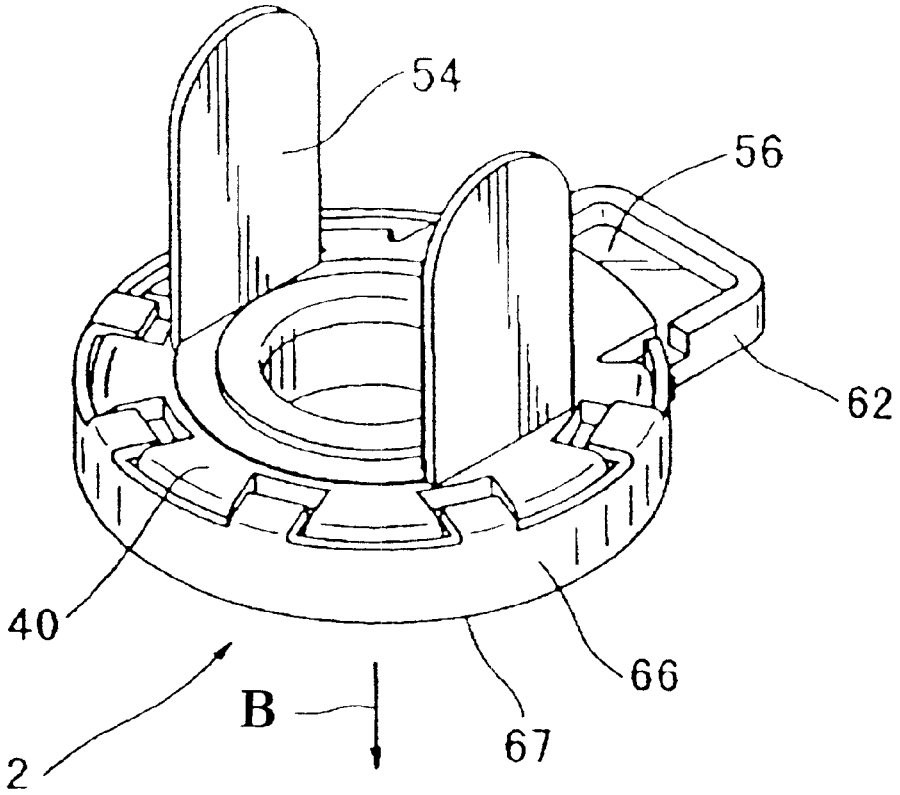
FIG. 1
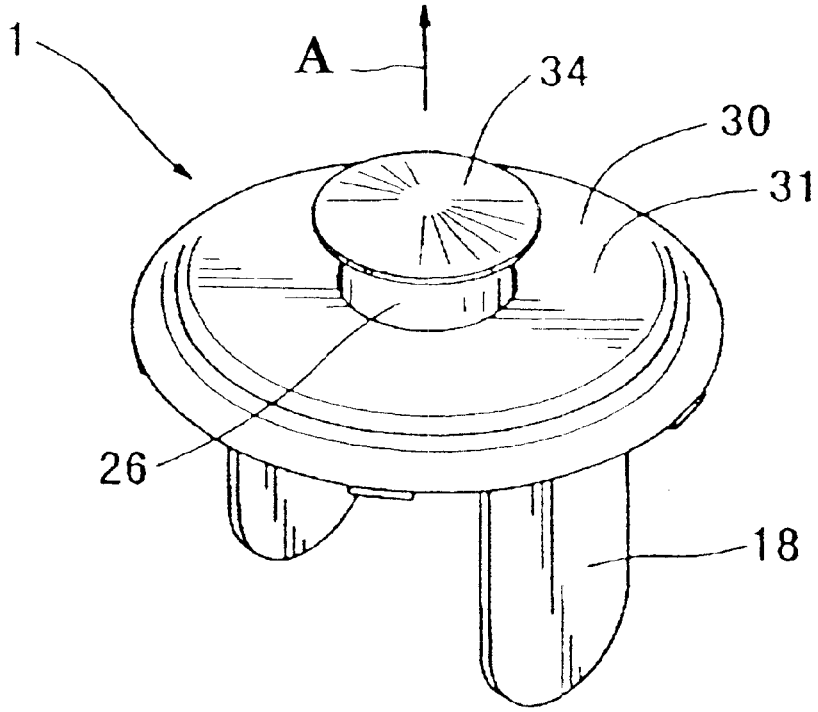

MAGNETIC FIXING UNIT

FIELD OF THE INVENTION

The present invention relates to a magnetic fixing unit, in particular, to a simplified magnetic fixing unit capable of automatically locking, for example, a handbag in a closed condition.

PRIOR ART

In order to keep the lid of, for example, a handbag, gag, knapsack, belt, or an attaché case, in a closed condition, various kinds of fixing units have been designed and are available. One of them is a magnetic fixing unit using magnetic force.

An example of a magnetic fixing unit, described above, is shown in official Report No. 2944564 patent applied Heiseil 194638 which was applied for by the applicant of this patent application. This magnetic fixing unit comprises a first assembly which is attached to one member of a pair of members which have to be joined together, and a second assembly which is attached to the other member of said pair of members. The pair of members can be, for example, a handbag lid and a main body of a handbag. The above first and second assemblies are capable of not merely keeping a handbag in a closed condition, but also of automatically locking the handbag in the closed condition following the magnetic closing operation of the assemblies.

More specifically, these assemblies are attracted and combined with each other at their front surface by allowing a projecting portion installed on a front surface of the first assembly to pass through a hole formed on a front surface of the second assembly by an operation of magnet, and enable to lock their combination under the condition that a projection placed on a tip of the projecting portion of the first assembly interferes with the engaging portion member attracted on a middle of the projecting portion of the second assembly when the first and the second assemblies are tried to separate by an attracting engaging portion member placed on the second assembly to the middle of the projecting portion of the first assembly with making use of the operation of a magnet.

Generally speaking, metal is considered as appropriate material for the body of the assemblies. However, since it is necessary that the bodies be formed and processed by punching, pressing, or bending an inexpensive thin metal is preferred in order to cut production costs. However, strength is a significant consideration when a thin metal is used to make the assembly body. Since, as described above, the assemblies are fixed to the lid and body of a handbag this fixing method may require a bending of the metallic parts of the assemblies by tools such as hammers. If the strength of the metallic assemblies is weak, they may be deformed or weaken by the affixing process. Accordingly, reinforcement of the assembly is strongly desirable. Moreover, material other than metal, for example, plastic and the like, can possibly be used to form the assembly.

As described previously in a closing operation, the projecting portion of the first assembly is passed through a hole of the second assembly. After the assemblies are combined, a horizontal lateral shift may occur relative to the top to bottom axis. This shift can cause a problem when an attempt is made to disengage the assemblies because the lateral shift of the projection of the first assembly within the hole of the second assembly can cause it to catch within the second assembly and as a result, a smooth engagement and disengagement may not be achieved.

The magnetic fixing unit described in applicant's patent report number 2944643, is designed to be installed on the annular projecting portion so as to prevent a mutual shifting either upon or after the first and the second assemblies are combined with each other. However, the installation of the annular projecting portion has shortcomings. One such shortcoming is that the thickness of the annular projecting portion may become an obstacle when a purse is opened. Another shortcoming is that the appearance the fixing unit gives is an undesirable thick appearance. Thus the manufacturers are faced with the undesirable choice of including the annular projecting portion to order to prevent the mutual shifting but if that is done, you end up with an undesirable looking exterior.

SUMMARY OF THE INVENTION

An example embodiment of the magnetic fixing unit comprises a first and second assembly. The first assembly comprises an engaging means, the second assembly comprises a guide means. When the first and the second assemblies are engaged with each other, the engaging means is generally led an inside of the guide means. The engagement assemblies may be automatically locked due to a magnetism of magnet applied to an engaging member formed on the second assembly. Further, a rim-shaped guide means covers a side of an attracting surface of the other assembly formed on the side of the attracting surface of either of said assemblies. An extending guide portion is formed on the engaging means of the first assembly and the extending guide portion combined with a hole of said second assembly prevents a vertical mutual shifting of the first and second assemblies. Further, a gap member between said engaging member and magnet effects smooth movement of the engaging member.

PROBLEMS SOLVED BY THE INVENTION

The object of the present invention is to improve the operation of prior magnetic fixing units preventing a mutual shifting between its first and second assemblies, and simultaneously reinforcing the strength of the assemblies without spoiling the fixing units exterior appearance.

According to one aspect of the present invention, a magnetic fixing unit is provided with a first assembly which is attached to one member of a pair of members which are to be attached, and a second assembly is attached to the other member of said pair of members. The first and said second assemblies are attracted and combined with each other at their attaching surface by the operation of a magnet disposed on either said first or second assemblies. Moreover, the first assembly comprises an engaging means projected from its attracting surface. Which said second assembly comprises an internal guide means so as to facilitate the entry and receipt of said engaging means into said guide means when the first and the second assemblies are combined with each other. In addition, said second assembly is provided with means to lock said engaging means to said second assemblies when said first and second assemblies are combined with each other. Finally, a release means to release said lock means is provided.

According to one embodiment of the present invention the first assembly is provided with a magnetic engaging means, while said second assembly is made of a magnetic mating engaging means, such that upon the combination of said first and said second assemblies, said mating engaging means of said second assembly moves by magnetic attraction toward a lock position relative to the engaging means of said first assembly.

According to another embodiment of the present invention, the opening which attracts said mating engaging mans to the engaging means of said first assembly is installed on a part of a guide means of said second assembly.

According to another embodiment of the present invention, a magnetic guide means is provided.

According to still another embodiment of the present invention, said second assembly also comprises a frame having an attracting surface, and a housing member which houses said corresponding engaging means located between one surface of said frame and an opposite surface to said surface of said frame, said guide means may be installed on said frame, one housing member, or on a combination of guide means on said frame and guide means on said housing member.

According to yet another embodiment of the present invention, said frame is forced by punching, bending, pressing or otherwise processing a thin plate.

According to another embodiment of the present invention, the reinforcing plate is installed on a surface opposite to said attracting surface of said frame, and said annular engaging means is located between said reinforcing plate and said housing member.

According to another embodiment of the present invention, a reinforcing guide means which covers said guide means is installed on said reinforcing plate.

According to another aspect of the present invention, there is provided a magnetic fixing unit comprising a first assembly which is attached to one member of a pair of members which are to be fastened and a second assembly which is attached to the other member of said pair of members, said magnetic fixing unit characterized in that said first and said second assemblies are magnetically attracted to each other by an operation and said first assembly comprises an engaging means projected from its attracting surface, and said second assembly comprises a guide mans extended inside of said second assembly from its attracting surface, with said engaging means being directed into said guide means when said first and second assemblies are combined with each other, said second assembly includes a mating engaging means which locks said first and said second assemblies together following combination of said first and second assemblies, and a release means to release said mating engagement means from its lock position.

According to an additional aspects of the present invention, a magnetic fixing unit comprising a first assembly which is attached to one of a pair of members which are to be combined and a second assembly which is attached to the other member., said magnetic fixing unit characterized in that said first and said second assemblies are attracted and combined with each other at their attaching surface by a magnet disposed on either said first or said second assemblies and said first assembly comprises an engaging means projected from its attracting surface toward said second assembly, the size of the outer diameter of said engaging means is substantially the same as or bigger than the outer diameter of a tip end portion of aid engaging means, said second assembly comprises a hole at an attracting surface thereof, and said engaging means of said first assembly is lead into said hole of said second assembly, said second assembly comprises a mating engaging means which locks the combination of said first and said second assemblies by moving into a lock position when first and second assemblies are combined with each other, and a release means to release said mating engaging means.

According to an embodiment of the present invention, a guide means that faces an opposite direction to a combination direction with said first assembly from an attracting surface of said second assembly and projects over inside of the second assembly until substantially the same length as that of said engaging means on said combination direction is formed on a hole of said second assembly, said guide mans is lead inside of said guide means when said first and said second assemblies are combined with each other.

According to another aspect of the present invention, a magnetic fixing unit comprising a first assembly which is attached to one member of a pair of members which are to be combined and a second assembly which is attached to the other member of said pair of members, said magnetic fixing unit characterized in that said fist assembly comprises at least a fixing plate and an engaging portion formed on said fixing plate, said second assembly comprises at least an engaging member which is made of magnetic material and may be moved to a locking position relative to said engaging portion, a release means which is applied to said engaging member to move it from said locking position to a release position, a magnet located between said fixing plate and said engaging member when said first and said second assemblies are combined with each other so as to form a magnet gap between said magnet and said engaging member disposed on either of said first and said second assemblies, and said engaging member being designed so as to be movable to the locking position on said engaging portion by operation of said magnet plate.

According to an embodiment of the present invention, said magnet gap is formed by a non-magnetic member or a plating made of a non-magnetic member.

According to an embodiment of the present invention, said magnet is disposed on said first assembly and said engaging portion is disposed on said magnet exclusively of said fixing plate.

BRIEF DESCRIPTION OF THE DRAWINGS

FIG. 1 is a perspective view of an example of a magnetic fixing unit of the present invention with its constituent first and second sub-assemblies engaged;

BRIEF DESCRIPTION OF REFERENCE NUMERALS

Figure 2:
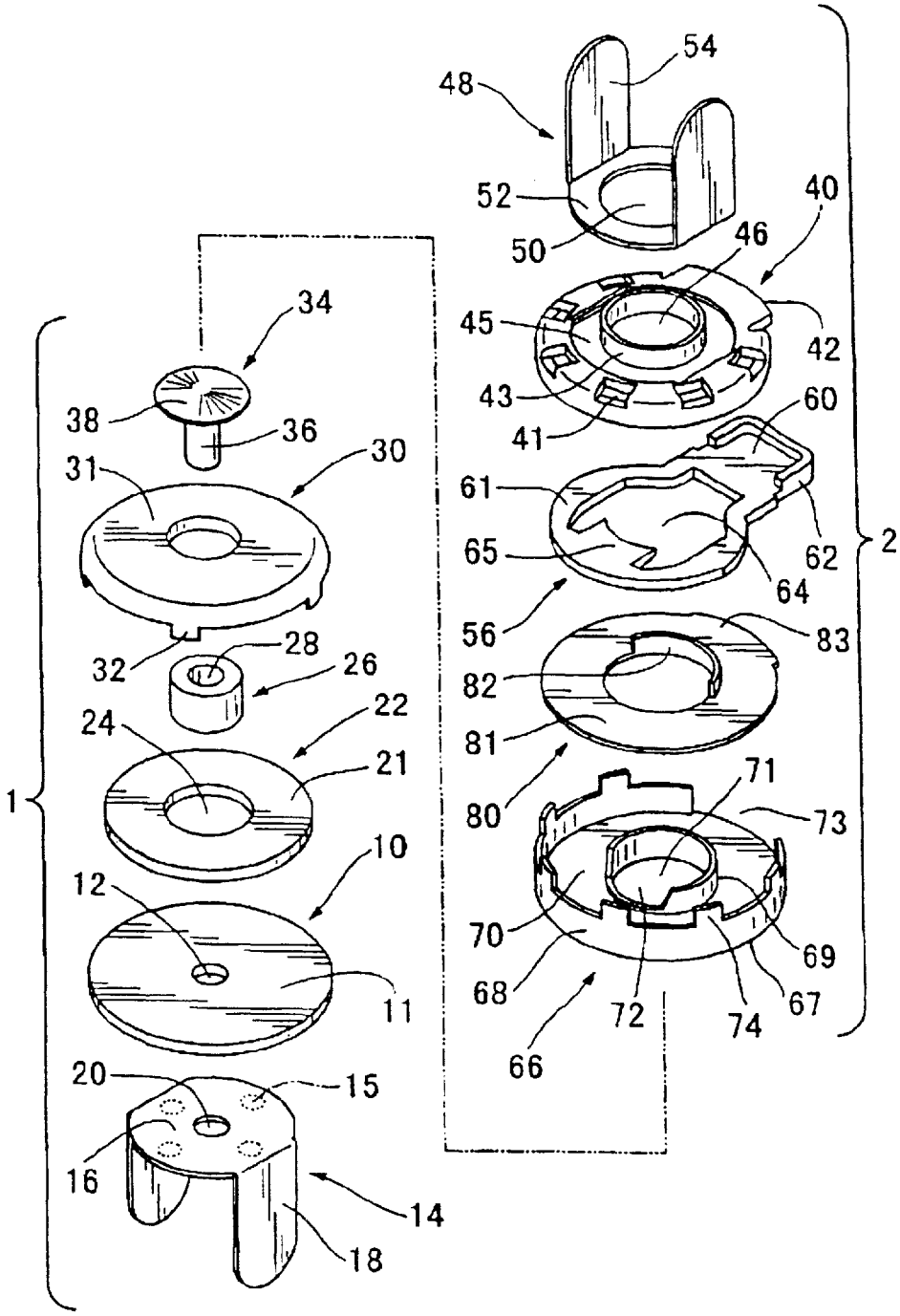
FIG. 2 is an exploded view of the first and the second sub-assemblies of FIG. 1.

1 first assembly
2 second assembly

10 annular plate
10*a* side surface
11 attracting surface
14 retainer
22 magnet
26 cylindrical sleeve
27 extending guide portion
30 cover
31 attracting surface
30*a* side surface
33 rim-shaped guide
34 engaging pin
36 stem of engaging pin
40 housing member
48 retainer
56 slider
65 engaging portion of slider
66 annular frame
66*a* side surface
67 attracting surface
69 guide of annular frame
75 rim-shaped projected-out portion
80 reinforcing plate

EMBODIMENT

There will now be described several preferred embodiments of the present invention.

FIG. 1 is a perspective view of an assembled magnetic fixing unit according to the present invention. As shown in the drawings, the magnetic fixing unit of the present invention comprises a first assembly 1 and a second assembly 2. Each of these pairs of assemblies is, as described later, fixed respectively to one of a pair of mating members (for example, a main body and a lid of a handbag) of an object to be equipped with said magnetic fixing unit. These assemblies are movable in the combination direction of the first and the second assemblies, as shown in FIG. 1, by the arrows A & B, such that the assemblies will be attracted and combined with each other at respective attracting surfaces 31 and 67. As a result, the mating members of a handbag, for example, will be kept in a closed condition. In the magnetic fixing unit of this invention, the first and the second assemblies will not only be combined with each other but the assemblies will be magnetically and automatically locked together. This locked condition of the unit can be easily released by the operation of the second assembly.

Figure 3:
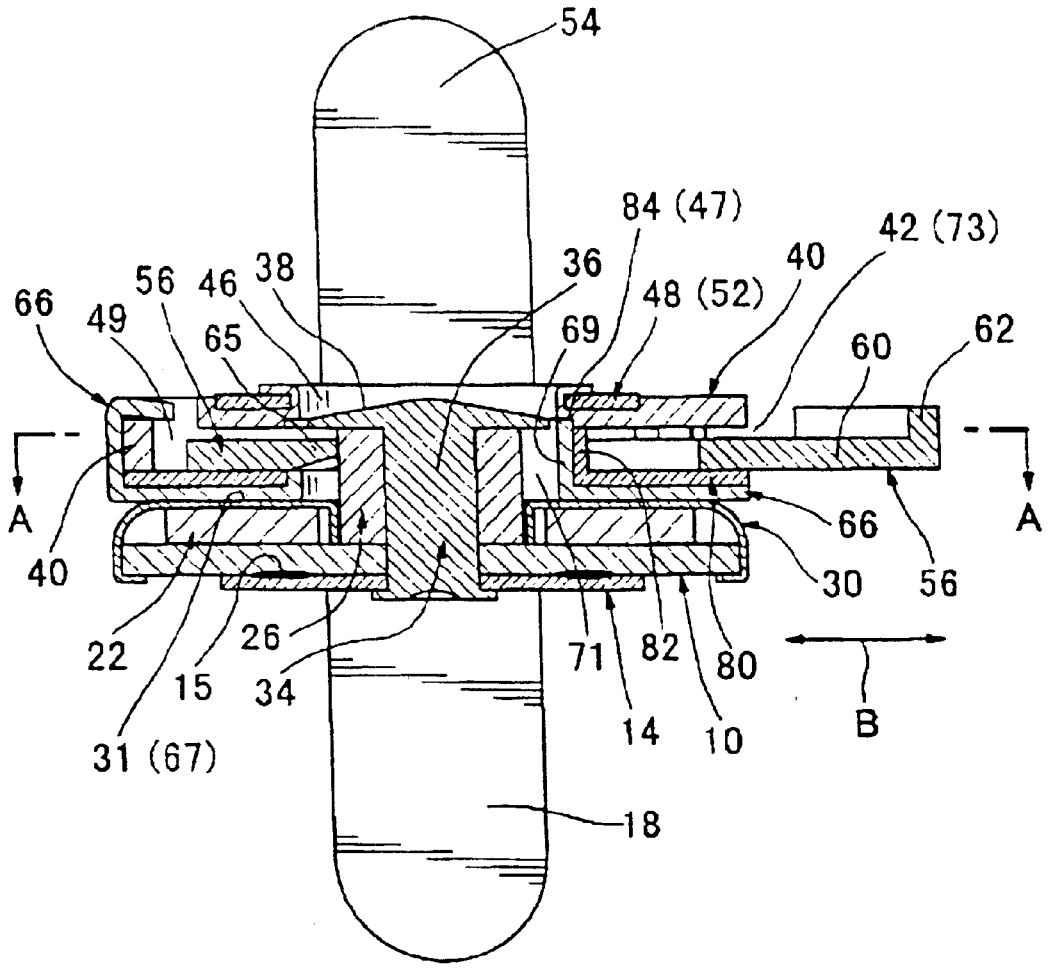
FIG. 3 is a cross-sectional view of a locking operation when the fist and the second sub-assemblies of FIG. 1 are engaged with each other.

FIG. 2 is an exploded view in perspective of assemblies 1 and 2. Further, FIG. 3 shows a cross sectional view along the center line of the magnetic fixing unit according to the present invention illustrating a combined condition of the first and the second assemblies of FIG. 1. These drawings show components of each of the assemblies in detail. The details of the component of each of the assemblies will be described mainly with reference to FIG. 2.

The first assembly will be initially described.

As shown at the left side of FIG. 2, the first assembly comprises an annular plate 10, a retainer 14 which is fixed to said annular plate 10, a magnet 22 and a cylindrical sleeve 26 which are attracted and attached onto the annular plate 10 by a magnetic force. A cover 30 which covers said magnet 22 and the annular plate 10 is also shown to be so formed to enable an engaging pin 34 to pass through the center of first assembly 1. As described later, this annular plate 10, however, can, if desired, be eliminated.

The annular plate 10 maybe either of a non-magnetic material such as plastics or a magnetic material. When the annular plate 10 is made of iron, a plating is usually applied thereto for anti-corrosion purposes. A hole 12 formed at the center of the annular plate 10 enables the engaging pine 34 to be passed therethrough.

The retainer 14 is fixed onto the bottom of the annular plate 10, by for example, spot welding, solder and wax welding and caulking are employed in order to ensure fixing the retainer 14, to annular plate 10. Four circles 15, shown in broken lines in FIG. 2, show solution portions caused by the spot welding process. The location of these solution portions is arranged at even 90° intervals so that force can be applied to the retainer 14 uniformly. The retainer 14 and the annular plate 10 do not have to be formed as separate components, but may be formed as one body. The retainer 14 may be made from any appropriate material, however, when it is formed in one unit with the annular plate 10, it will naturally be formed of the same as the annular plate. Further, the retainer 14 may have the same effect as that of the annular plate 10. If magnet 22 is made of a last magnet and either the annular plate 10 or the retainer 14 or all parts 22, 10 and 14 may be formed into one body. Various members may be fixed to other members by a screw caulking welding, or other appropriate methods. Further, a plating may be applied to said plastic magnet 22.

The retainer 14 comprises an annular portion 16 and two fixing portions 18 which extend downward from opposite sides of said annular portion 16. The annular portion 16 of the retainer is fixed to the annular plate 10, while the fixing portions 18 are used to fix the first assembly to, for example, either the main body of a handbag or a handbag lid. At the center of the annular portion 16, a hole 20 having approximately the same size as the hole 12 of the annular plate 10 is formed. Retainer 14d and the annular plate 10 are aligned with each other so that an aligning hole for the engaging pin 34 to be passed through is formed.

The ring-shaped magnet 22 is attached onto the opposite side of the annular plate 10 from that to which the retainer 14 is attached. The outer diameter of magnet 22 is preferably smaller than the outer diameter of annular plate 10. Magnet 22 is a permanent magnet which has a N-pole or S-pole on one side or surface thereof and the opposite polarity on the other side or surface. Therefore, the magnet 22 can be attracted and attached to annular plate 10 by its own magnet force. As a result of the magnetic attraction and attachment of magnet 22 to annular late 10. It is magnetized and also generates a magnetic force. The magnetic force of the annular plate 10 has the important role of attracting cylindrical sleeve 26 to it. The magnet 22 may be neodymium magnet or any other type of magnet. While the thickness of magnet 22 may be from 0.5 mm to 10 mm, its thickness may not be limited in these ranges. Furthermore, a plating may applied to said magnet 22.

The cylindrical sleeve 26, as shown in FIG. 2 will be attached to the same side of annular plate 10 as the magnet 22. While in the present embodiment, the cylindrical sleeve 26 is shown to be located near to the center of the annular plate 10, it need not be so located. When the cylindrical sleeve 26 is located near to the center of the annular plate 10, it is placed directly on the annular plate 10 so that it does not obstruct or interfere with an inner edge of a center hole 24 of the magnet 22. Also, cylindrical sleeve 26 need not necessarily be located away from the magnet 22, but may be brought into contact with the magnet 22. The cylindrical sleeve 26 may alternatively be fitted directly into the ring hole of magnet 22, and if that is done, the annular plate 10 can be omitted. Also, if a plastic magnet 22 is used, the cylindrical sleeve 26 and plastic magnet may be formed into one unit. Further any combination of the annular plate 10, retainer 14, and cylindrical sleeve 26 may be attached together by a screw, caulking or any other appropriate methods.

The cylindrical sleeve 26, similar to the annular plate 10, is made of a magnetic material. Therefore, the cylindrical sleeve 26 can be attracted by and attached to the magnetized annular plate 10. Obviously, when the cylindrical sleeve 26 is attracted and attached to the annular plate 10 by a magnetic force, the cylindrical sleeve 26 is also magnetized. As a result, the cylindrical sleeve will also generate a magnetic force. The magnetic force of the cylindrical sleeve plays an extremely important role of attracting the engaging member 64 of assembly 2, as will be described later. The cylindrical sleeve 26 and the annular plate 10 maybe formed into one unit.

When the cylindrical sleeve 26 is magnetically attached onto the annular plate 10, the top of the cylindrical sleeve 26 will project over magnet 22. Further, the cylindrical sleeve projects outward from an attracting surface of the first assembly (31) toward the direction of the second assembly to permit a combination therewith. The cylindrical sleeve 26 also has a through hole 28 along a longitudinal direction thereof, whose size is almost the same as those of the hole 20 of the retainer 14 and the hole 12 of the annular plate 10. When the cylindrical sleeve 26, the annular plate 10, and the retainer 14 are aligned, these holes form an aligning hole to be penetrated by the engaging pin 34.

The cover 30 is attached to the magnet 22 and the annular plate 10. As shown in FIG. 2, cover 30 has a ring-shaped corresponding to that of the magnet 22. It is of a size which is suitable for covering almost all of the upper surface of the magnet 22 and annular plate 10, except for a portion of the bottom and side surface of the annular late 10. As described above, cover 30 does not have to be formed with rim when the outer diameter of the magnet 22 is smaller than that of the annular plate 10. Therefore, a smooth curved surface will be formed at said rim. When cover 30 is placed over magnet 22 and the annular plate 10, five fixing legs 32 extending downward from an outer lower periphery of cover 30 and project over the bottom surface of the annular plate 10. When these fixing legs 32 are bent inward along the bottom surface of the annular plate 10, the cover 30 will be fixedly attached to the magnet 22 and the annular plate 10 to form an integrated unit. Though the material of the cover 30 is not limited to a particular type, the present embodiment employs a nonmagnetic material, such as brass. Cover 30 is provided so as to protect magnet 22 and annular plate 10 and to make the connection there between stronger. However, the cover may be omitted. The outer diameter of the magnet 22 may be either smaller or larger than the diameter of annular plate 10. When there is no cover used, magnet 22 and annular plate 10 are preferably joined together by bonding or by the use of other well known methods for making a stronger connection therebetween. When a cover 30 is used, the surface that is attracted to the attracting surface of the second assembly 67 is the font side 31 of said cover 30. On the other hand, when there is no cove used surface 21 of magnet 22 will be attracted to second assembly 20. Even if cover 30 is used, the annular sleeve 26 projects outward from the attracting surface 31 of cover 30 of first assembly 1 in the direction of the second assembly 2.

The engaging pin 34 is installed by being inserted into the aligned hole formed by holes of the cylindrical sleeve 26, the annular plate 10, and the retainer 14. The engaging pine 34 comprises a stem 36 and a head 38 formed on said stem 36. Only the stem 36 of the engaging pin 34 is inserted into the aligning hole. Head 38 is not inserted into said aligning hole.

The stem 36 of the engaging pine 34 is made to have a length that is longer than the total length of the aligning hole formed by the holes of the cylindrical sleeve 26 and the like. Therefore, when the stem 36 of the engaging pine 34 is inserted into the aligning hole, the tip of the stem 36 can be projected out of the hole 20 of the retainer 14 which forms the most bottom side of the aligning hole. By caulking the projecting-out portion (not shown) of the stem 36 against the bottom of the retainer 14 or by fixing the projecting portion of the stem 36 to the retainer 14 using welding, screwing or other appropriate methods the engaging pin 34 will be fixed to the annular plate 10 and the cylindrical sleeve 26. As an additional alternative, the end portion of the stem 36 projections below retainer 14 may be flatten to be even with the bottom surface of the retainer 14 or may be formed to be slightly projected from said bottom surface.

When the engaging pin 34 is inserted through the aligning hole, its head 38 projects above the top of the cylindrical sleeve 26. At least a portion of the head 38 is made of a non-magnetic material, and therefore will not be affected by a magnetic force. As described hereinbelow, when the first and the second assemblies are combined together, the head 38 penetrates a central portion of the second assembly, and since, as described previously, this head 38 is not affected by the magnetic force, a combining operation of the first and the second assemblies is not achieved due to the head 38 being magnetically attracted by any part of the second assembly. The other remaining portion of the engaging pin 34 except the head 38, that is, the stem 38 may be made of a magnetic material or of a non-magnetic material. Head 38 of the engaging pin 34 is formed to have a conical surface so that even if head 38 is brought into contact with the engaging piece 65 of slider 56, the frictional resistance between the head 38 and the engaging piece 65 is decreased. As a result, the engaging piece 65 can be easily and smoothly moved and the head 38 can be easily inserted into the aligned holes of the second assembly.

The second assembly will now be described.

As shown in the right portion of FIG. 2, the second assembly comprises an annular frame 66, a reinforcing plate 80 which is housed in the annular frame 66, a housing member 40 which forms a housing space, and the reinforcing plate 80, a slider 56 which is held in the housing space formed by the reinforcing plate 80 and the housing member 40 so as to be able to move freely, and a retainer 48 which is fixed in the housing space 40.

The annular frame 66 is preferably made of a magnetic material such as iron. By being made of a magnetic body, the annular frame 66 has outstanding effects as described later. First, a magnetic force from the first assembly can be applied to the annular frame 66 when the first and the second assemblies are combined with each other. Further, a stronger attracting force between the first and the second assemblies is generated when the magnetic force of the first assembly is applied to not merely a slider 56 but also the annular frame 66. Second, when the first and the second assemblies are combined with each other, the slider 56 will operate smoothly due to the annular frame 66 functioning as a yoke. Even when said annular frame 66 is made of plastic, brass, or the other non-magnetic body, the latter effect described previously, may result. This will be described in greater detail hereinbelow.

The annular frame 66 is formed into an integrated unit by penetrating, bending, and pressing of relatively thin and flat metal plate. These methods keep production costs low.

However, it is not necessary that any of the above procedures be used to form the annular frame into the integrated unit, and other production methods might be used if desired. For example, a cylindrical guide 69 and the annular frame 66 or other portion may be formed into separated pieces and the cylindrical guide 69 may be attached later. Also, instead of placing the guide 69 on the annular frame 66, another member corresponds to the guide 69 may be formed on the housing member 40 side. Further, a pat of the guide 69 (or some other member corresponds to the guide 69) may be placed on both the annular frame 66 and the housing member 40. Thus, a complete guide that is formed by any of these combinations are acceptable alternatives. Also, the various alternative material and production method available and can be used.

The annular frame 66 is formed with a surrounded outside wall portion 68, an inside wall portion, that is, the guide 69, and a front wall portion 70. Though it is not obvious from the drawing, the front surface (attracting surface) of the annular frame 66 is kept flat. This front surface (the opposite surface to the surface shown at FIG. 2 of the drawing is labeled as attracting surface 67 and is attracted to the attracting surface 31 of the first assembly.

The inside wall portion, that is, the guide 69 is a notable point. Said guide 69 has a substantially cylindrical-shaped which has a specific inner diameter and is projected out from an inner hole of the second assembly in a direction opposite from the attracting surface 67, (see FIGS. 1 and 3). There are three reasons to install the guide 69. First, the guide 69 prevents any mutual horizontal shifting created between the first and the second assemblies. It is not necessary to install guide 69 if there is a little or no mutual shifting during or after the first and the second assemblies are combined with each other. However, in practice, relatively big mutual shifting occurs. Thus mutual shifting will prevent a proper operation of a magnetic fixing unit. Guide 69 is installed to solve this mutual shifting problem. That is, the guide 69 prevents the mutual horizontal shifting created between the first and the second assemblies when or after these assemblies are combined with each other. Reference to FIG. 3, more specifically shows that a head 38 of the engaging pin of the first assembly is lead inside of the second assemblies along a hole 71 which is formed inside of the guide 69, and the head 38 is prevented from shifting horizontally within the second assembly by guide 69. As the example, when the locking function of slider 56 is released by a pressing force being applied to its guide 69 preventing a hole 71 from being off from the head 38 due to the annular frame 66 being pushed toward the horizontal direction.

The second reason why the guide 69 is installed is to reinforce the strength, in a top to bottom direction, of the annular frame 66. As will be described, the second assembly is fixed on an object, such as a handbag, by respectively bending and driving the fixing portion 54 of the retainer 48 which is fixed on the housing member 40. As a result a considerable force will be applied to near the retainer 48, in other words, near center of the housing member 40 and the annular frame 66 in the top to bottom direction. Said force may be large enough to either destroy the housing member 40 and the annular frame 66, and thus what amounts to the second assembly, or to substantially deform parts 40 and 66. In particular, since in this present embodiment, the annular frame 66 is formed from a relatively thin plate, it is capable of being destroyed or easily deformed during its production such that slider 56 will not be able to be properly moved between locking and unlocking positions. Accordingly, this problem is solved by the installation of the guide 60 near the center of the annular frame 66 and a reinforcing guide 82 to reinforcing plate 80 to further reinforce the strength of annular frame 66.

The third reason why the guide 69 is installed relates to the open portion 72 of guide 69. The open portion 72 is designed to function so that the slider 56, especially its engaging portion 65 can approach and be attracted within guide 689, by the cylindrical sleeve 26 which is magnetized by the first assembly and following coupling of assemblies 1 and 2 is located within the guide 69. As shown in FIGS. 2 and 3 the size of the open portions in guide 69 is made large enough to pass the engaging portion 65 of slider 56 through. The third reason why the guide 69 is installed is so that slider 56 is only affected by a magnetic force at its engaging piece 65. Thus, the guide is open only at 72 to magnetically attract engaging piece 65 but the remaining portion of guide 69 functions as a magnetic shield for the remaining portion of the slider 56.

In order to accomplish these three purposes completely effectively, the guide 69 is constructed to shield with an angle over 180°, and for the present embodiment, to shield around 240°. Put another way the opening 72 in guide 69 is around this angular range and is efficient enough to attract the slider 56 to the cylindrical sleeve 26 of the first assembly by a magnetic operation applied to the engaging portion 65 of the slider 56, and, at the same time to prevent shifting in the horizontal direction created between the first and the second assemblies when or after these assemblies are combined with each other. In addition, the limited angular opening 72 of guide 69 enables the remaining portion of guide 69 to reinforce and strengthen in the top to bottom direction of the annular frame 66. When 72 is of an angular opening smaller than 180°, for example, the purpose of the guide 69 will not be served since insufficient magnetic strength will be provided. Nevertheless, under proper circumstances a designer may determine that the opening 72 may be smaller than 180°. Further the height of the guide 69 above front wall 70 is normally made to be equal to the length of cylindrical sleeve 26 and the head 38 after the combination of the first and the second assemblies. Inner diameter of the guide 69 is slightly bigger than outer diameter of the head 38. However, the length of the guide 69 and a design of its inner diameter are determined by designer's preference.

Plate 80 also serves to reinforce the annular frame 66. However, reinforce plate 80 can be omitted since it only serves to reinforce the annular frame 66. The opening in reinforcing plate 80, as shown in FIG. 2 of the drawings, fits over guide 69 and sets upon the opened back surface 70 of the annular frame 66.

Although reinforcing plate 80 is, similar to the annular frame 66, formed of a single part by penetrating, punching, or bending of thin magnetic plate, it needs not to be formed in one unit and may be formed in a similar shape in one or more parts by any well known production methods. Steel metal used for the reinforcing plate 80 may be similar to that of the annular frame 66 and the reinforcing plate 80 is formed through similar production procedure to that of the annular frame 66. In this case, production costs will be inexpensive. However, similar to the annular frame 66. It needs not to be formed in one unit and may be formed from a non-magnetic material.

The reinforcing plate 80 is of a shape or size which enables it to provide reinforcing strength to the front wall portion 70 of the annular frame 66 and the inside wall portion, that is, the guide 69. Reinforcing plate 80 comprises a main body portion 81 which corresponds in size and opening to the front wall portion 70 of the annular frame 66 and whose shape is similar to a doughnut shape. Also reinforcing guide portion 82, which corresponds to the wall portion 70 of the annular frame 66, extends from its main body portion 81 in a top and bottom direction and serves to reinforce the upper extending cylindrical body of guide 69.

When the reinforcing plate 80 is housed inside of the annular frame 66, the main body portion 81 of the reinforcing late 80 covers almost the entire inside of the front wall portion 70 of the annular frame 66. Front wall portion 66 is the opposite or backside of attracting surface 70 of the annular frame 66. A projection portion 83 installed on the outer diameter of the main body portion 81 is fitted in the open portion 73 of outer wall portion 68 of the annular frame 66 when the reinforcing plate is housed in the annular frame 66. The reinforcing plate 80 can only be housed in the annular frame 66 in one way because of the projecting portion 83 and the opening portion 73 on reinforcing plate 80 and the open portion 73 of annular frame 66.

Although the reinforcing guide 82 is shown to cover less than a 1800 arch, it may be made to cover the same angular arch as guide 69. As shown in FIG. 3, the height of the reinforcing guide 82 is less than that of the guide 69 of the annular frame 66. The reason for this will be described later. It is obvious from the relation between the angular range or expanse of the reinforcing guide 82 and the angle range or expanse of the guide 69 of the annular frame 66 that the reinforcing guide frame 82 thoroughly plays a role to reinforce the annular frame 66 even though the reinforcing guide frame 82 does not encircle the entire perimeter of the guide 69. While the reinforcing guide 82 may encircle the while perimeter of the guide 69 of the annular frame 66 and have a larger angular range than that of the guide 69, it must be kept I mind that the opening to ensure that the engaging portion 65 of the slider 56 is able to float freely into and out of its locking position must be preserved. On the other hand, it is obvious from the relation between the height of the reinforcing guide 82 and of the guide 69 of said annular frame 66 that the difference in level 84 in the top to bottom direction, shown in FIG. 3, is formed by the guide 69 and the reinforcing guide 82 when the reinforcing plate 80 is housed in the annular frame 66. The difference in height 84 between the guide 69 and the reinforcing guide 82 forms a mutual supplemental shape to a difference in level 47 place on the housing member 40. As described later, when the difference in level 84 and 47 are placed correspondingly, an aligned hole which does not have an opening substantially is formed, a hole which is formed by the guide 69 is substantially extended, and the strength of said hole is enhanced.

When the reinforcing plate 80 is made a magnetic body such as iron, various effects described in relation to the annular frame 66 will result. However, if the purpose of reinforcing plate 80 is only to intensify the strength of the annular frame 66, this objective can be attained even though the reinforcing plate 80 is made of non-magnetic body. But, if the attracting and yoke functions of the annular frame 66 are to be enhanced by the reinforcing plate 80, the reinforcing plate should be made of a magnetic body. That is, if the reinforcing plate 80 is made of magnetic material, the magnetic force of the first assembly will be applied to both the annular frame 66 and the reinforcing plate 80 and a stronger attracting force will be produced in between the first and the second assemblies when the first and the second assemblies are combined with each other. Further if in addition to the annular frame 66, the reinforcing late 80 functions as a yoke with regard to the magnetism from the fist assembly, the slider 56 will work smoothly. Moreover, even though these effects are achieved when the reinforcing plate 80 or the annular frame 66 is made of a non-magnetic body, better effects will be brought about when the annular frame 66 and the reinforcing plate 80 are made of a magnetic material.

The slider 56 is used to lock the first and the second assemblies together automatically when these assemblies are combined with each other. Further, the second assembly is attracted to the first assembly as a result of the operation of the magnet from the cylindrical sleeve 26 located in the fist assembly. Following the combining of the fist and second assemblies the magnetic attraction of slider 56 will lock the first and second assemblies together.

In the present embodiment, though the slider 56 is formed in one unit by manufacturing operation requiring penetrating, bending, and pounding in order to cut its production costs, it needs not to be formed as a single unit and other production methods may be used. In this regard slider 56 is similar to annular frame 66 or the reinforcing plate 80. While slider 56 is shown to have a bilateral symmetry key shape, another shape is possible. In operation, when the first and second assemblies are combined, the engaging pin 34 of the first assembly and the cylindrical sleeve 26 located on the periphery of the engaging pin 34 both pass through the hole 64 which is located t or near the center of the slider 56.

The slider 56 offers a main body 61 and a lever 60. The engaging portion 65 which is shown as projecting into hole 64, is part on the main body 61. When the first and the second assemblies are combined with each other, the engaging portion 65 is attracted to the cylindrical sleeve 26 which is located on the periphery of the engaging pin 34 of the first assembly and locks these assemblies automatically. The engaging portion 65 is shown to have a half moon shape, but other shapes are possible. Also while the engaging portion 65 is shown to have a conical or ramp like surface which gets thinner toward its edged, corresponding in shape the head 38 of the engaging pin 34 of the first assembly which is also tapered, it needs not to be formed. As shown in FIG. 3, if the engaging portion 65 may be brought into contact with the head 34 of the engaging portion 65 when the first and the second assemblies are combined with each other, frictional resistance between the engaging portion 65 and the head 34 will be decreased by making the shape of the engaging portion 65 correspond in shape to that of the engaging pin 34. The magnetic attraction from the cylindrical sleeve 16 occurs at the end of the conical surface of the engaging piece 65. On the other hand, lever 60 can be manually moved to release the engaging portion 65 which is attracted to the cylindrical sleeve 26 of the first assembly and release or unlock the combination of assemblies 1 and 2.

As shown in FIG. 2, slider 56 is located over the reinforcing plate 80 which is housed in the annular frame 66, and the main body portion 61 of the slider 56 is positioned below housing member 40. As shown in FIG. 3, a space 49 is formed on the housing member in order to house the slider 56 and the main body portion 61 of the slider 56. On the other hand, the lever portion 60 of the slider 56 is exposed outward through an opening portion 42 which is formed on the outer wall portion of the housing member 40. The housing member 40 will upon assembly be housed in the annular frame 66 in a predetermined direction such that the opening portion 42 which is projected from the housing member 40 will be fitted into an opening portion 73 which is correspondently formed on the outer wall portion 68 of the annular frame 66. When the member 40 is housed in the annular frame 66, only the lever portion 60 of the slider 56 is projected out from the housing space which is formed by the housing member 40 and the annular frame 66. At the same time, respective opening portions 42 of the housing member 40, the reinforcing plate 80, and opening portion 73, and the main body portion 61, enable and permit the engaging portion 65 to be floatable and housed within this housing space. It is clear from the shape of the opening portion 42 of the housing member 40 and of the slider 56 that the floatable direction of the slider 56 is in a direction in line with the opening portion 73 formed on the housing member 40 and the outside wall portion 68 of the annular frame 66.

Following the placement of housing member 40 in annular frame 66, six fixing pieces 74 which are projected out of the outer wall portion 68 of the annular frame 66 are respectively bent into cutout portions 41 of the housing member 40. In this way the housing member 40 will be fixed to the annular frame 66.

The slider 56 inside of the housing space, and in particular, its engaging portion 65, is able to be manually moved easily by operation of its lever 60. As a result the engaging portion 65 will be able to be easily moved out of its locking position. The movement of the lever portion 60 results in the engaging portion 65 of the slider 56 passing interference free through the opening portion 72 which is formed on the guide 69 of the annular frame 66, and away from the magnetized annular sleeve 26 of the first assembly which is located on the inner part of the guide 69. Since the approach and attraction of the engaging piece 65 to the annular sleeve 26 occurs automatically due to magnetic operation of the cylindrical sleeve 26, a primary objective for the lever portion 60 is to be able to manually disengage engaging portion 65 away from the engaging pin 34 and move it away from its locking position. In order to facilitate the movement and operation of the slider 56, a tongue portion 62 is formed on the end of the lever 60 by upwardly bending the lever 60 to form the perimeter shown in FIG. 2.

The operation of the magnet of the first assembly upon slider 56 does not depend on the material from which slider 56 is made, and thus slider 56 may be made of a magnetic body or a non-magnetic body material. If all of the components of the second assembly, the engaging portion 65 of the slider 56 is the only portion which is needed to be made of a magnetic body material. When the slider 56 is formed in one unit by non-magnetic body material, the engaging portion 65 may be coated with a magnetic-plating, or may be covered by a magnetic body or it may be made to have the properties of a magnetic body by other well-known methods. When the slider 56 is made in sections, it is not necessary to make the whole body of magnetic body materials. In other words, only the engaging portion 65 which is attracted to the first assembly needs to be made of the magnetic body, and the other remaining parts of the first assembly may be made of a non-magnetic body. Further, depending upon the design, the engaging portion 65 may be moved away from the cylindrical sleeve 26 by a movement of the lever portion 60 which is installed on either of the engaging portion 65 or the main body 61 or both. The design employed is left to the designer's preference. However, additional considerations become important when the whole body of the slider 56 is made of a magnetic body, since parts of the magnetic-made slider 56 other than the engaging portion may be attracted to the engaging pin 26 of the first assembly. If parts of the slider 56 are attracted to the pin 36, then disabling the lock resulting from the attraction of the engaging portion 65 will not function properly. Therefore, it is necessary to contrive a way to ensure that only engaging portion 65 is attracted to the cylindrical sleeve 26. On the opening located in a center of the slider 56, the engaging portion 65 of the slider 56 is shown at FIG. 2 to be projecting from the side on which the cylindrical sleeve 26 of the first assembly is placed. Also, the engaging portion 65, in particular, the part of engaging portion 65 contacting the engaging pin 34, is received deeper toward the farther side from the cylindrical sleeve 26 of the first assembly. That is, toward farther direction from the hole. As described previously, the slider 56 is formed with bilateral symmetry since it is capable of moving in either direction. Due to this shape, magnetic force applied to the engaging portion 65 is much larger than that which will be applied to the remaining part of the slider 56. With the structure of the engaging portion 65 shown, attraction to the cylindrical sleeve 26 due to the operation of the magnetic shield by the guide 69 of the annular frame 66 is greatly enhanced. However, the recessing at the slider 56 shown in FIG. 2 is not always necessary, since in most circumstances, the engaging portion 65 is ensured attracting to the cylindrical sleeve 26 by only the operation of the magnetic shield from the guide 69. Design of an engaging portion, a lever portion, and of a slider is up to designer's preference.

The retainer 48 is fixed on the housing member 40 and its configuration is as same as that of the retainer 14 which is fixed on the annular plate 10. That is, the retainer 48 comprises an annular portion 52 and two fixing portions 54 which extend upward from opposite sides of the annular portion 52. The annular portion 52 to be fixed to the housing member 40, while the fixing portions 54 are used to fix the second assembly to an object such as the main body of lid of a handbag. Further, the retainer 48, is similar to retainer 14 which is fixed on the annular plate 10 of the first assembly. However, the size of a hole 50 of the retainer 48 which is fixed on the housing member 40 is different from that of a hole 20 of the retainer 14. However, hole 50 of the retainer 48 is not always necessary and could be omitted. There is an advantage with providing a hole 50 in retainer 48 since it enables the first and second assemblies to be coupled more closely since the hole 50 can receive a part of engaging pin 34, in particular, its head 38 (see FIG. 3). As a result, the combined first and second assemblies will be able to be more tightly joined and a thinner profile of the combined assemblies will result.

The purpose f the housing member 40 has been previously described. Its material may be either a magnetic body or a non-magnet body since the operation as the housing member 40 is achieved with either material. An annular projected out portion 43 is formed on an annular hollow section 45. The projected-out portion 43 and the hollow 45 are of a size to accommodate the hole 50 and annular portion 50 o retainer 48. That is, it is obvious from FIG. 1 to FIG. 3 that when the retainer 48 is fixed on the housing member 40, the hole 50 of the retainer 48 is fitted over the projected-out portion 43 of the housing member 40, the annular portion 52 of the retainer 48 is received in the hollow 45 of the housing member 40 which is formed to a shape corresponding to that of annular portion 52. Also, after the annular portion 50 is fitted around projection 43 and into annular hollow 45, the outer perimeter of projection 43 is turned down upon the annular portion 50 and the retainer is caulked into position to prevent removal. Accordingly, the retainer 48 is fixed onto the housing member 40 at a predetermined place.

As described previously, the annular raised level 47 formed on the housing member 40 corresponds to the difference in level 84, which is the difference between the height of the guide 69 of the annular frame 66 and the height of the inner portion 82 of the reinforcing plate 80. These differences in level 84 and 47 have a similar supplemental shape and their strength, for the top and bottom direction, is enhanced when they are mutually engaged with each other. Further, the hole 46 of the housing member 40 and the hole 71 which is formed inside of the guide 69 of the annular frame 66 are ensured alignment by an engagement of the differences in level 84 and 47. When the hole 46 and the hole 71 are aligned, a mutual opening is hardly ever formed. Therefore, the first assembly, in particular the head 38 of the engaging pin 34 will not be caught, and the first and second assemblies can therefore be smoothly engaged with each other.

There will now be described the locking motion which occurs when the firs and the second assemblies are engaged with each other, with reference to FIG. 3. A combining motion between the first and the second assemblies is accomplished by a magnetic operation between a plurality of components of the first and the second assemblies. When the first and second assemblies get close to each other and their distance of separation decreases the assemblies are clicked together by the magnetic operation between the slider 56 and the first assembly, or the magnetic operation between the slider 56 and annular frame 66 and the reinforcing plate 80 and the first assembly when the annular frame 66 and/or the reinforcing plate 80 are made of magnetic material.

When the first and the second assemblies are combined with each other, the front surface of the cover 31, a front surface of magnet 22 if a cover 31 is not used, of the first assembly is magnetically attracted to the front surface of the annular frame 66 of the second assembly. As a result, engaging pin 34 and the cylindrical sleeve 26 which are projected out on the top portion of the first assembly, see FIG. 1, are inserted into the previously described aligned hole of the second assembly. The penetration of the engaging pin 34 into the hole of the second assembly, its head 38 will reach hole 46 formed by the housing member 40. The magnetic attraction causes the assemblies to assume the structural configuration shown FIG. 3 with at least a top end portion of the cylindrical sleeve 26 penetrating the space formed between the housing member 40 and the annular frame 66.

In magnetic fixing unit of this invention, the first and the second assemblies are not only combined but they are automatically locked together. The automatic locking is accompanied by a cooperative magnetic operation between the magnet 22, the cylindrical sleeve 26, the annular frame 26, and the engaging portion 65 of slider 56. More specifically, as previously described, the magnetic attraction between annular sleeve 26 and the engaging portion 65 occurs as a result of the cylindrical sleeve 26 being magnetized by the magnetic force generated by the magnet 22 through the annular plate 10. After combination of the assemblies, engaging portions 65 will be located near the cylindrical sleeve 26, and thus attracted to the outer surface of the cylindrical sleeve 26. As shown in FIG. 3, upon the engaging portion 65 of the slider 56 being attracted to the cylindrical sleeve 26, the aligning hole of the second assembly is made narrower or partially closed by the engaging portion 65. In fact the restriction results in an interference between the engaging portion 65 and the engaging pin 34, and more particularly between the engaging portion 65 and the back surface of the head 38 of the engaging pin 34. The attraction of the engaging portion 65 to cylindrical sleeve 26 and below the head 38 lock the first and second assemblies together and prevents them from being pulled apart. That is, the first and the second assemblies are lift in the automatically locked condition. This locking operation is shown in more detail with reference to FIG. 4.

The operation as a yoke when the annular frame 66 or the reinforcing plate 80 is made of a magnetic body will additionally be described. The combination of the assembly and the second assembly results in magnetization by magnet 22 of the annular frame 66 and/or the reinforcing plate 80. In turn, the slider 56 will be attracted to not only the cylindrical sleeve 26 but also the annular frame 66 and/or the reinforcing plate 80. While one might naturally conclude that the attraction of the engaging portion 65 of the slider 56 to frame 66 and/or plate 80 would prevent it from being smoothly attracted to the cylindrical sleeve 26. In practice the engaging portion 65 is smoothly attracted to cylindrical sleeve 26 because the annular frame 66 and/or the reinforcing late are operated as a yoke.

In order to describe this yoking principle magnet 22 is assumed to have the S-magnet pole on the surface of the annular plate 10 side thereof and the N-magnet pole at its opposite side. Magnetic lines of flux from the S-pole are gathered onto the near end portion of the cylindrical sleeve 26 resting on the annular plate 10, which functions as a yoke. The cylindrical sleeve 26, will generate the strongest magnetic force near this end portion. At the same time magnetic lines of flux from the N-pole to the S-pole, are gathered near the outer periphery of the annular frame 66 and the reinforcing plate 80. Therefore, except for the outer periphery of outer frame 66, the magnetism on the remaining part of the annular frame 66, which includes a part located on the slider 56, is made weaker and therefore the attracting force applied to the slider 56 is made weaker. As a result, since the magnetic force near the end portion of the cylindrical sleeve 26 where the magnetism is gathered approximately to one point is greater than that on the annular frame 66 where the magnetic force is reduced by the generation of the magnetic flow, the engaging portion 65 of slider 56 can be smoothly attracted and attached to the cylindrical sleeve 26. The magnetic operation and yoking operation described hereinabove, does not mean that the annular frame 66 or the reinforcing plate 80 ought to be always made from a magnetic body. However, the beneficial results ending with a smooth effective attraction of the engaging portion 65 to cylindrical sleeve 26, when these components are made of a magnetic body are clear.

The slider 56 is arranged and formed to move smoothly as it is attracted to the cylindrical sleeve 26. One way to accomplish this is that a magnetic gap member (not numbered) made of a non-magnetic material is inserted in between the slider 56 (in particular, its engaging portion 65) and the magnet 22. For example, depending on the strength or size of the magnet, the shape or square measure of the engaging portion 65 corresponds to the cylindrical sleeve, the transfer distance, or cooperative magnetic operation with the other members. The magnetic gap member, made of a non-magnetic material and whose thickness is 0.01 mm–10 mm, is located between the engaging portion 65 a d the magnet 22. As a result, the slider 56 will be smoothly attracted to the cylindrical sleeve 26. This has been experienced by the inventor of the present invention. In addition, instead of inserting the magnetic gap member, a non-magnetic plating may be applied to the slider 56 itself, the magnet 22 itself, or any member located between the slider 56 (in particular, its engaging portion 65) to provide the same kind of effect. The thickness of the plating can be controlled by a dipping period into the plating solution, and therefore when an appropriate thickness of plating is applied to the slider 56, the same effect as that described above might be provided. Hitherto, a magnetic gap material made of a non-magnetic has not been known in the art. For example, as released in patent published shown 50-112170, which is owned by the present applicants, a magnetic cover made of a non-magnetic material is formed to protect a magnet, and may appear to be a magnetic gap member, since it results in being located between the magnet 22 and the slider 56. However as in the conventional example, the magnet cover made of a non-magnetic material has not been formed to, and is not intended to enable the slider 56 to move smoothly. In the structure depicted by patent published shown 50-112170 described above it was necessary to from the magnet cover for protecting a magnet, since only a fragile magnet such as ferrite magnet was provided. Accordingly, the magnet cover of patent published shown number 50-112170 is formed for protecting magnet, and is not intended to and is not formed to enable the slider to move smoothly. Referring to the present application, the present inventor discovered that even if the magnet cover was made of a non-magnetic material, depending on its thickness, it would operate as a magnetic gap member to enable the slider 56 to move smoothly. In addition, a non-magnetized magnetic gap member may be combined with a magnetic member or a magnetic plating. Further, a coating or a plastic or other material may be considered as the other non-magnetized magnetic gap member. Still further, instead of using the magnetic gap member, an empty space may be used. This selection is by design preference.

Related to the principle described above, in this magnetic fixing unit it is necessary to move the slider 56 to a lock release position before the first and the second assemblies are combined with each other. That is, in this magnetic fixing unit, though the engaging portion 65 of the slider 56 is located in the obstructing position which may cover the aligned holes of the second assembly, the slider 56 will be naturally and easily shifted from the lock positioned through an interference of, in particular, the head 38 portion of the engaging pin 34 of the first assembly with the engaging portion 65. The shifting will be easy because according to the principle described previously, the force that the slider 56 is attracted to the annular frame 66, the reinforcing plate 90, and/or the magnet 22 is lessened and the friction resistance between the engaging portion 65 and the head 38 of the engaging pin is lessened. In this case, after the engaging portion 65 is shifted from said position once, it is able to be automatically attracted to the cylindrical sleeve 26 again and thereby automatically complete the lock. Therefore, in this magnetic fixing unit, it is necessary to make the location of the slider 56 move to the lock release position before the fist and the second assemblies are combined with each other.

Figure 4A:
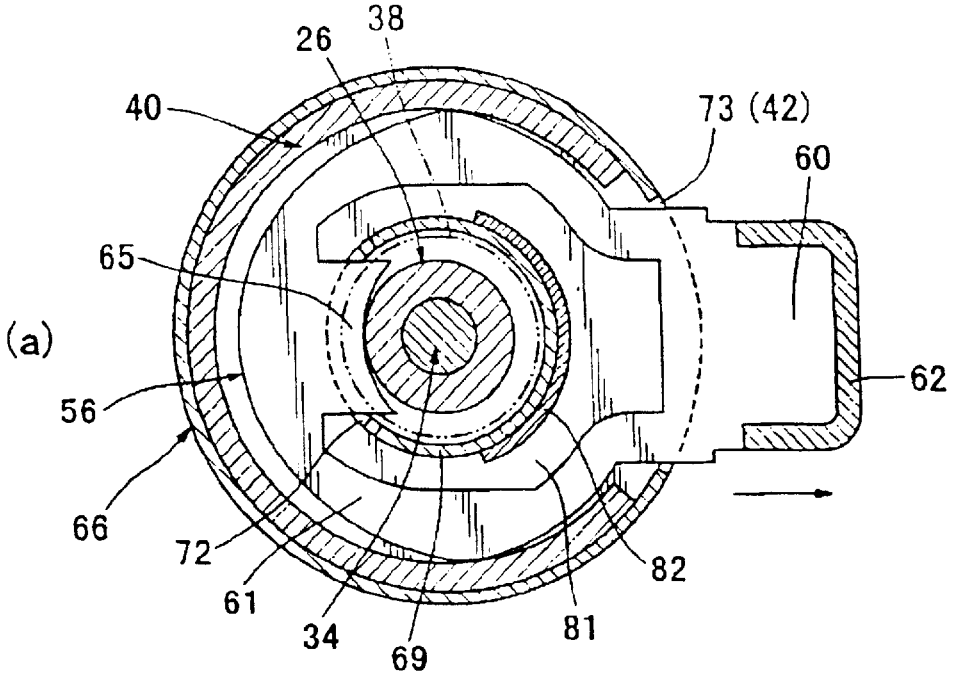
FIG. 4 is a cross sectional view taken along the line A—A of FIG. 3.
Figure 4B:
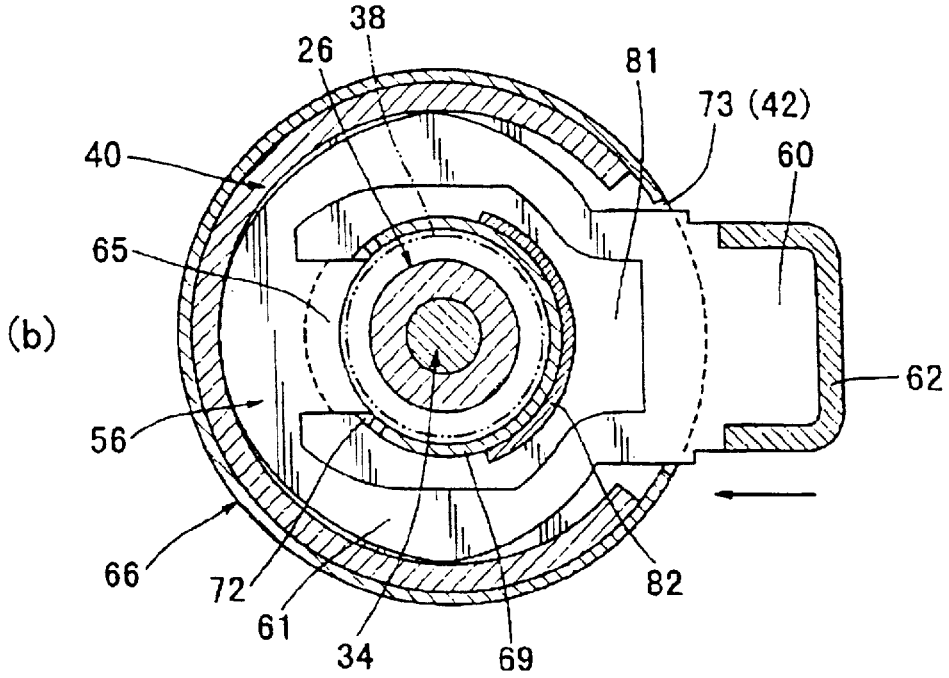

FIGS. 4*a* and 4*b* are cross sectional views taken along the line A—A of FIG. 3. These drawings show the relative arrangement of the slider 56 and nearby components in both a lock position and a release position. In particular, FIG. 4*a* shows the relative arrangement of parts in the lock position and FIG. 4*b* shows the relative arrangement of parts in the release position respectively.

As is obvious form FIG. 4*a*, in the lock position, the engaging portion 65 of the slider 56 is disposed in a position where the engaging position 65 is attracted and attached to the outer surface of the cylindrical sleeve 26. As a result, when the engagement between the first and the second assemblies is attempted to be released (that is, when the engaging pin 34 is attempted to be moved perpendicularly upward on the drawing), the locking condition cannot be released because the head 38 of the engaging pin 34, in particular the portion therefor shown by a broken line, interferes with the engaging portion 65 of the slider 56.

In order to release this lock condition, as shown in FIG. 4*b*, the engaging portion 65 should be moved to at least outside of the periphery of the head 38 of the engaging pin 34. The engaging portion 65 can be moved by moving the slider 56 along the arrow direction shown on the drawing. When the slider 56 is moved along the arrow, the engaging portion 65 is moved away from the head 38, and thus the interference between the engaging pin 34 and the engaging portion 65 is released. The lock condition is thereby released. Both before and after the lock is released, the magnetism from the first assembly substantially acts through to the engaging portion 65 of the slider. This is, described above, due to the configuration of the slider and the function of the magnetic shield of the guide 69 frame 66.

Figure 5:
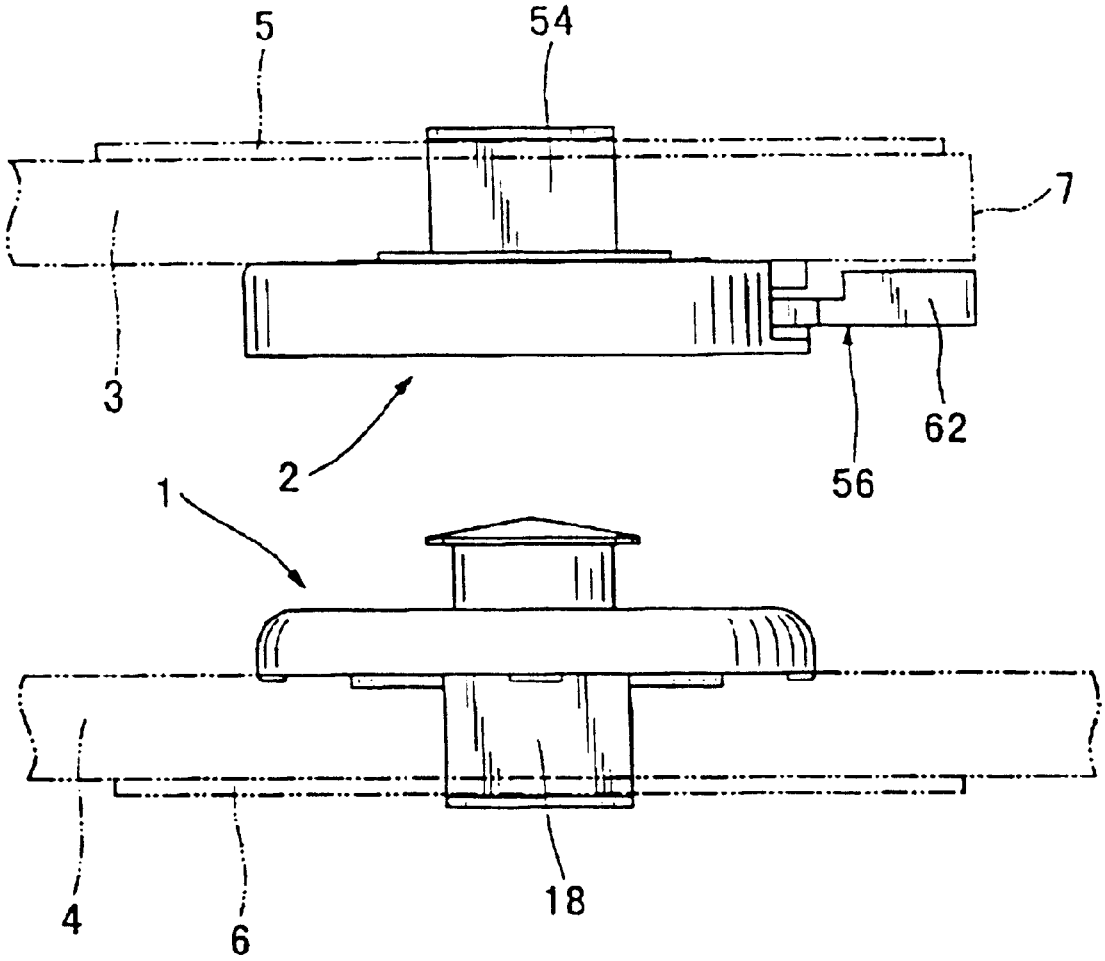
FIG. 5 shows an example of a practical application of the magnetic fixing unit of the present invention.

Next, some examples regarding practical usage of the magnetic fixing unit of the present invention will be described with reference to FIG. 5. As previously mentioned, the magnetic fixing unit of the present invention may be applied to various objects such as handbag, bag, knapsack, belt, cigarette case, attache case, doors, and the like. We now describe the uses of the invention with the handbag as a typical example. FIG. 5 shows the first and the second assemblies, Nos. 1 and 2 respectively, each being attached to an enlarged handbag as viewed from the outside looking in.

According to the present embodiment, the first and the second assemblies are fixed respectively to a right side of a handbag main body 4 and a reserve side of a lid 3 of a handbag. Contrarily, the first assembly may be fixed on lid 3 of the handbag and the second assembly may be fixed to the handbag main body 4, respectively.

These assemblies are respectively fixed to predetermined places of a purse retainers 18 and 54 of the assemblies. As described above, each of these retainers respectively has two fixing portion s18 and 4 (shown in FIGS. 1, 2 clearly) and a pair f holes (not shown) for inserting the respective fixing portions is formed on corresponding portions of the main body 4 and the lid 3 respectively. The first and the second assemblies can be fixed to the main body 4 and the lid 3, respectively, by completely inserting respective fixing portions 18 and 54 into these holes and then bending them as required. As described previously, since strength, in the top to bottom direction, in said second assembly is intensified by the guide 69 of the frame 66, said second assembly will not be destroyed, deformed or its operation otherwise impaired by attachment of the fixing units to the purse.

Generally, in order to ensure fixing, washers 6, 5 are placed between the fixing portion 18 and the main body 4, and between the fixing portion 54 and the lid 3 respectively. The washers 6, 5 are formed with holes corresponding to those formed on the main body 4 and the lid 3. When washers are used, respective fixing portions 18 and 54 of the retainers are inserted into the hole formed on the body 4 and the hole of the washer or into the hole formed on the lid 3 and the hole of the washer respectively and secured to the body and lid by bending the fixing legs or portions. Further, though the retainers 14 and 48 are used for fixing the first and the second assemblies to handbag and the like, a caulking stop, a screw stop, or other methods may be used as well.

When the first and the second assemblies which have been respectively fixed of the main body 4 and the lid 3 are combined with each other, that is, when the lid of the handbag is located, the first and the second assemblies are located between the main body 4 of the handbag and the lid 3 of the handbag and thus re not visible from outside of the purse. The fixing lock between the first and the second assemblies is released by inserting a finger into a clearance between the main body 4 and the lid 3 and pushing the tongue portion 62 of the slider 56 of the second assembly. In order to facilitate this operation, it is preferable that the tongue portion 62 of the second assembly is positioned, as shown in the FIG. 5 drawing, near or the same location as an edge 7 of the lid 3. Nonetheless, the tongue portion 62 may be projected outwardly of the edge 7. Further, as with other release methods, it is possible to push the handbag portion in order to operate the lever of the second assembly. Though not shown in the drawing, the main body 4 and the lid 3 are formed by folding at least two sheets of leather or cloth. The bent legs or fixing portions 18 and 54 are then located between the respective folded sheets. Accordingly, these fixing portions are not visible from the outside of the purse. Further, the tongue 62 of the slider 56 is proximate the edge 7 of the lid 3, so as to interfere with the sewing of the lid by a sewing machine. The second assembly which includes the lever 60 and the tongue portion 62, can be turned to the right or left around 90 degrees when the fixing portion 54 is mounted on the predetermined position of the lid 3. Following the sewing operation, the second assembly including the tongue portion 62 will be returned to the predetermined position as shown at FIG. 5.

According to the fabrication method described above, since none of the parts of the assemblies are exposed or seen from the outside of the purse, various decorations (not shown) can be applied to appropriate visible outer surfaces of the purse according to the user's preference. Therefore, the magnetization of the fixing unit of this invention does not in any way affect the visible outer appearance of the purse.

While the above description of a practical example f usage of the magnetic fixing unit of the present invention has concentration on a handbag, the magnetic fixing unit of the present invention can be used not only for the handbag but also for a bag, belt, knapsack, cigarette case, attach case, knob of a door and any other objects which require to be locked. Therefore, the objects to which the magnetic fixing unit of the present invention can be attached are used are virtually unlimited.

In the embodiment described above, when the components are made of a nonmagnetic material, a non-magnetic plating may be applied to those components, to result in the same effect as if the components were made of a non-magnetic material. Therefore, in respective embodiments, the component to be made of non-magnetic material may be replaced by the magnetic components to which a non-magnetic plating is applied. Accordingly, plating can be used as an anticorrosive, decoration, and to make a part of a portion of the unit or a whole body to be a non-magnetic or a magnetic. Such a technique is considered as particularly effective when a part of material, for example, only the engaging portion 65 of the slider 56, is to be made magnetic. Also, while in the embodiment described above, the magnet 22 was made as part of the first assembly that is not critical and magnet 22 may be housed in the second assembly. For example, magnet 22 may be placed between the annular frame 66 and the reinforcing plate 80 of the second assembly or in between the slider 56 and the annular frame 10 if the reinforcing plate is omitted. The magnet may be made of a plastic magnet material, or applied by plating. Further, though the present invention of the magnetic fixing unit as a whole is shown to have a cylindrical shape, it is not always necessary to be cylindrical. For example, a square cylindrical shape, an ellipse cylindrical shape, or any other of a variety of shapes can be used for the magnetic fixing unit.

The annular plate 10 is, as described previously, not necessarily made of a magnetic material. It is obvious that if the annular plate 10 is made of a on-magnetic material, the magnet or the cylindrical sleeve 26 is not fixed to the annular plate 10 by an operation of the magnet 22. However, it is sufficient if the magnet or the cylindrical sleeve 26 is fixed by welding or by an adhesive, caulking, screw stop, or the other various methods. Similar structural considerations govern when the retainer is fixed on the magnet.

Further, the head 38 is, as described previously, preferably made of a non-magnetic material. However, the head 38 is not necessarily of a non-magnetic material, and may instead be made of a magnetic material.

Further, the cylindrical sleeve 26 of the first assembly does not necessarily pass through the closed housing space between the housing member 40 and the annular frame 66. Instead, it only needs to reach the near side of the slider 56. Even in this case, the slider 56 may be movable to the lock position due to the operation of magnet from the cylindrical sleeve 26.

As described in the conventional art, though the exterior appearance may be affected if the annular projected-out portion is formed on the second assembly, the guide 69 and the annular projected-out portion effectively prevent the horizontal mutual shifting between the first and the second assemblies.

For example, an annular projected-out portion or rum-shaped guide, may be formed on a circular rim of the annular frame of the second assembly which is shown in FIG. 3, in particular, a side surface on the attracting surface of 67. When the first and second assemblies are engaged with each other, the rim-shaped guide covers the circular rim of the first assembly (the example of the embodiment is the cover 30 or the circular rim of the magnet 22 when the cover 30 is not formed), and thus prevents a vertical direction of mutual shifting between the first and second assemblies.

Further, it is possible to prevent mutual shifting in a horizontal direction between the first and second assemblies by forming only the rim-shaped guide instead of the guide 69.

For example, a height of a rim-shaped projected-out portion is formed on the second assembly, that is, the height of the rim-shaped projected-out portion on a direction normal (a combination direction of the first and second assemblies) to a front surface of the second assembly (the example of the embodiment is the annular frame 66), and that height is made substantially the same or higher than that of the engaging pin formed on the first assembly.

In other words, it is substantially the same or higher than the height of projection of the engaging pin from the front surface of the first assembly (the example of the embodiment is the cover 30 or the magnet 22 if the cover 30 is not formed), in the normal direction (the combination direction of the first and second assemblies). Without forming the guide 69, the horizontal direction of the mutual shifting between the first and second assemblies will be able to be prevented, since a location of the first assembly is stipulated by the rim-shaped projected-out portion of the second assembly as long as the first and the second assemblies are engaged with each other.

Figure 6:
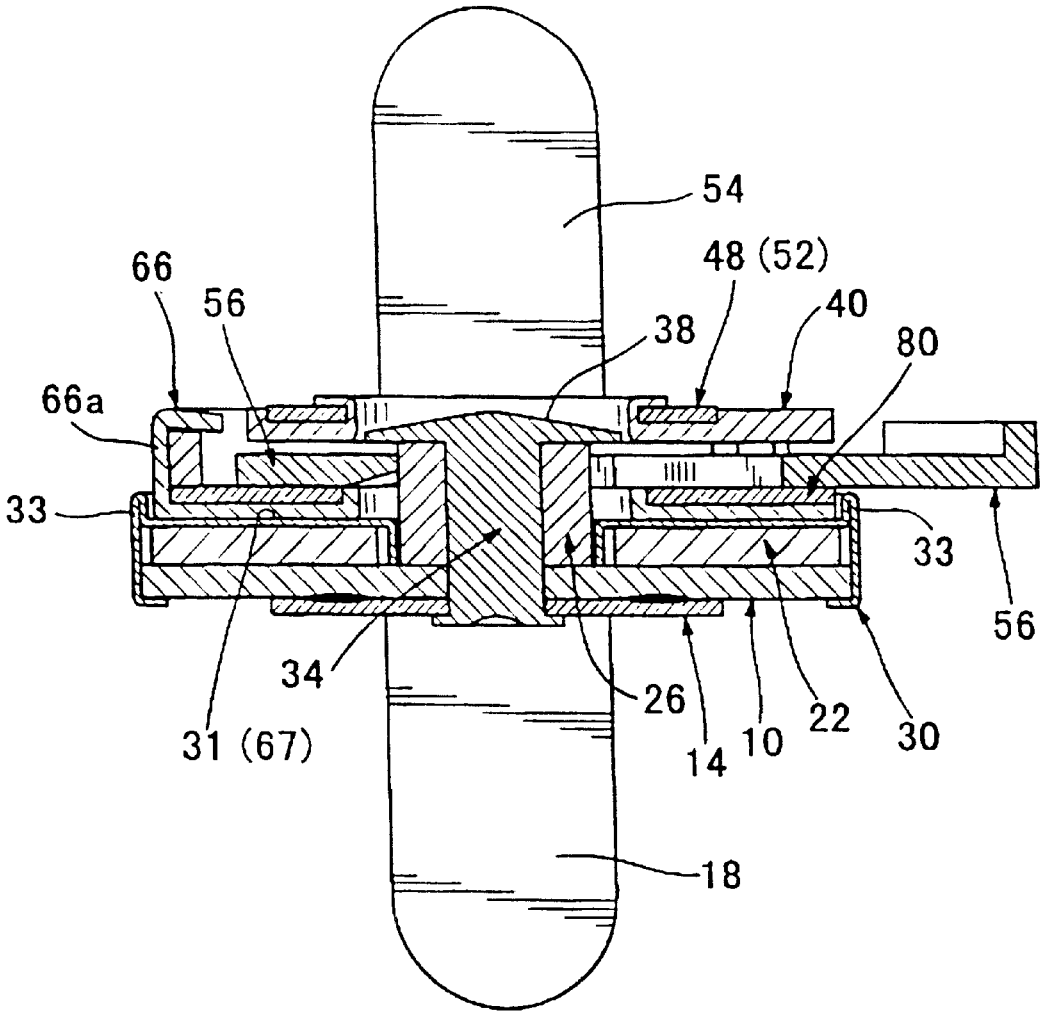
FIG. 6 shows an example embodiment of the rim-shaped guide of the magnetic fixing unit of the present invention.
Figure 7:
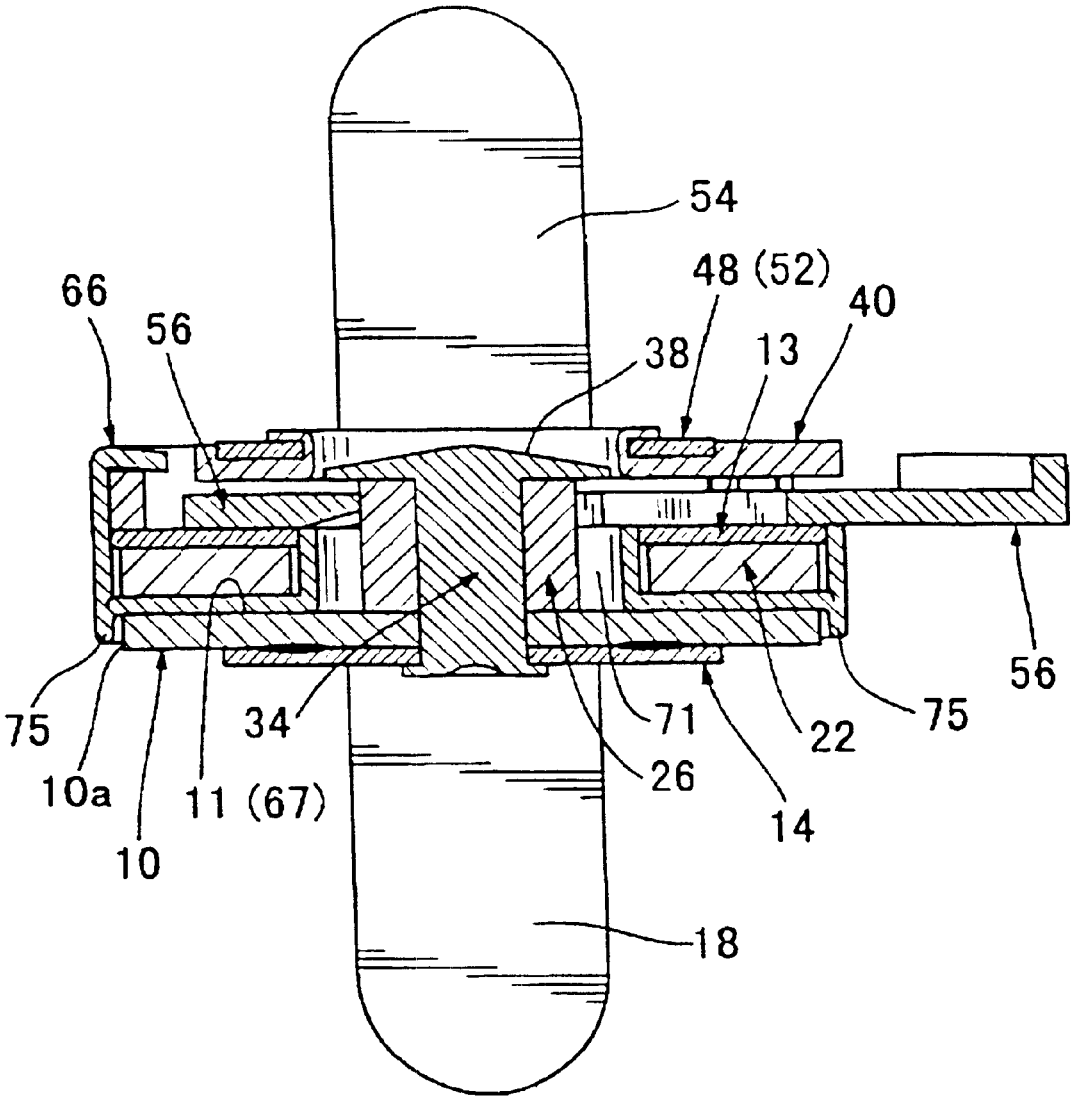
FIG. 7 shows another embodiment of the rim-shaped guide for the magnetic fixing unit of the present invention.
Figure 8:
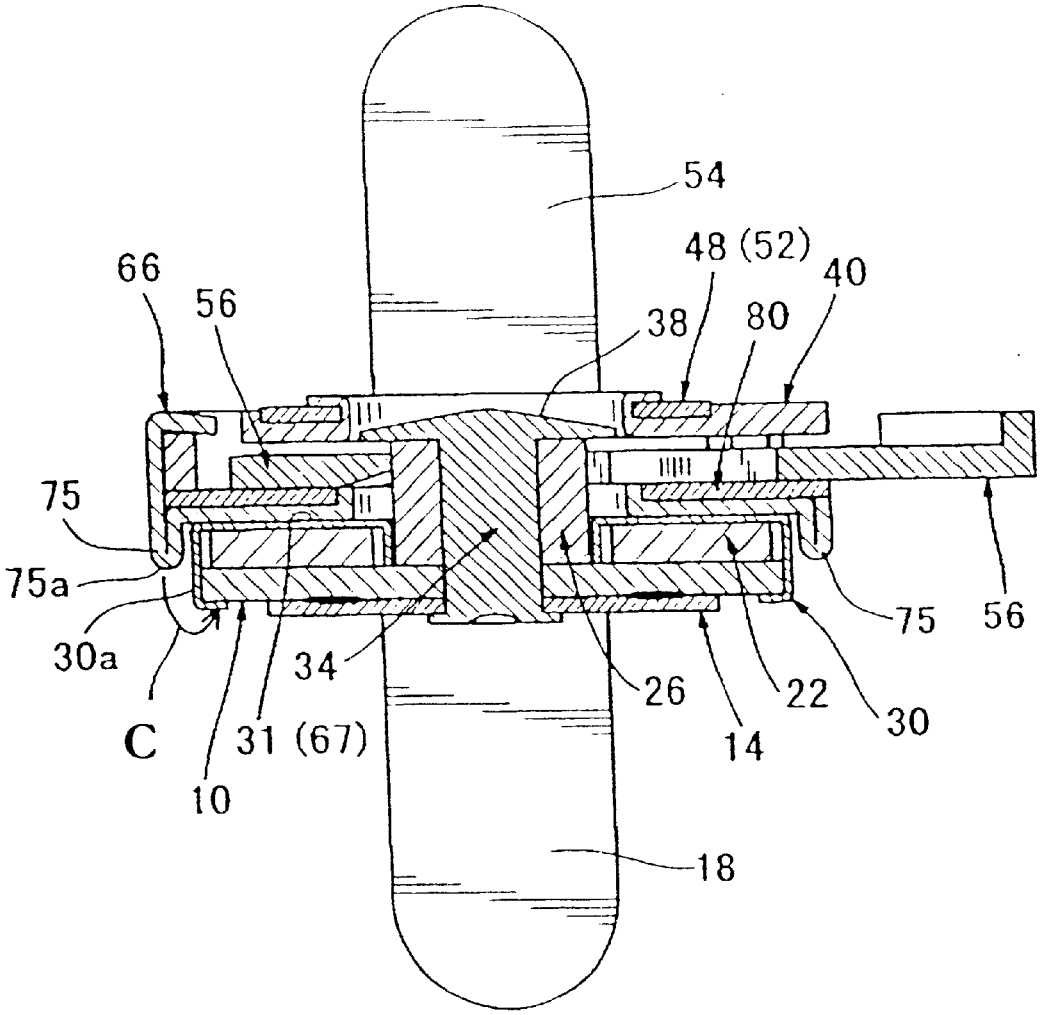
FIG. 8 shows a further embodiment of the rim-shaped guide of the magnetic fixing unit of the present invention.

With a reference to FIG. 6 through FIG. 8, an example of the rim-shaped projected-out portion will be described in detail. FIGS. 4 through 6 show the magnetic fixing unit on a cross-sectional view along a center line the same as that of FIG. 3. In addition, the item numbers in FIGS. 6 through 8 are the same as the item numbers in FIG. 1 to FIG. 5 to the extent these figures show like numbers with respect to FIG. 1 to FIG. 5. However, the guide (69 in FIG. 2 and FIG. 3) described above is not shown in FIG. 6 through FIG. 8.

The embodiment of FIG. 6 shows an example of the rim-shaped projected-out portion 33 and the magnet 22 formed on the first assembly. In the depicted embodiment, rim-shaped projected-out portion 33 is formed on the cover 30. When the first and the second assemblies are engaged with each other, the rim-shaped projected-out portion 33 formed on the side surface of the attracting surface 31 of the first assembly is led along the side surface 66*a* of the attracting surface 67 of the second assembly, while it is including the attracting surface 67 of the second assembly inside. After the first and second assemblies are engaged with each other, the rim-shaped projected-out portion 33 covers at least a portion of the side surface 66*a* of the attracting surface 67 of the second assembly. Upon and after the first and the second assemblies being engaged with each other, this component effectively prevents a horizontal direction of shifting between the first and second assemblies. In the example shown in the drawing, though rim-shaped projected-out portion 33 is formed by penetrating and pressing of the magnetic cover 30, it may be formed by other means. For example, without installing the magnetic cover (not shown in the drawing), the rim-shaped projected-out portion 33 may be installed on the main body of the magnet 22 and applied by the other methods. Further, the magnet 22 may be a plastic magnet or a plated plastic magnet.

In particular, as the embodiment shown in FIG. 6, when the magnet 22 and the rim-shaped projected-out portion 33 are formed in the same assembly, an effect which cannot be expected if these are formed in separate bodies will be obtained. To better describe this effect, the situation when the first and the second assemblies are not engaged with each other will be examined. In this condition, when either assembly installed on the magnet gets close to a magnetic card, in particular, a credit card or a train ticket, the magnetic card is usually destroyed due to an operation of the magnet. However, the installation of the rim-shaped projected-out portion 33 on the assembly does not allow the magnet card to get closer to said assembly when the magnet card interferes with the rim-shaped projected-out portion 33. This prevents and protects destruction of the magnetic card. As generally known, since an operation of a magnet is decreased inversely proportional to the unobstructed distance squared, even such a small distance as that provided by the rim-shaped projected-out portion 33 produces sufficient effect of protecting against damage to magnetic cards.

The embodiment in FIG. 7, in contrast, shows an example of the rim-shaped projected-out portion 75 and the magnet 22 being formed on the second assembly. However, in this embodiment, unlike that of FIG. 6, a cover is not formed on the annular frame 66 but, instead, a rim-shaped projected-out portion 75 is formed there. Since the magnet 22 and the rim-shaped projected-out portion 75 are formed on the same assembly, similar to that of the embodiment in FIG. 6, destruction of a magnet card will be prevented or effectively protected against. Similar to the embodiment in FIG. 6, in this embodiment, when the first and the second assemblies are engaged with each other, the rim-shaped projected-out portion 75 formed on the side surface of the attracting surface 67 of the second assembly is led along the side surface 10*a* of the attracting surface 11 of the first assembly as it encloses over the attracting surface 11 of the first assembly inside. After the first and the second assemblies are engaged with each other, the rim-shaped projected-out portion 75 covers at least a portion of the side surface 10*a* of the attracting surface 11 of the first assembly. Therefore, upon and after the first and the second assemblies are engaged with each other, this component effectively prevents a horizontal direction of shifting between the first and the second assemblies. In the example shown in the drawing, though rim-shaped projected-out portion 75 is formed by penetrating and pressing of the annular frame 66, it may be formed by other means. The member shown in FIG. 7 by reference number 13 is a magnetic gap member.

In the embodiment shown in FIG. 7, the rim-shaped projected-out portion 75 not only prevents horizontal mutual shifting but also produces another effect. More particularly, when the first and the second assemblies are engaged with each other, these assemblies are closed with each other under the slightly shifting condition. As described with reference to FIG. 5, when this present invention of the magnetic fixing unit is applied to a main body of a handbag and a handbag lid, said condition is frequently occurred). In such a condition the head 38 of the engaging pin 34 of the first assembly is not inserted into the hole 71 of the annular frame 66, and the head may interfere with the front surface (attracting surface 67) of the annular frame. However, even in such a case, because of the rim-shaped projected-out portion 75, as long as the head 38 of the engaging pin 34 of the first assembly is inside of said rim-shaped projected-out portion 75, the head 38 of the engaging pin 34 makes it easy to lead the hole 71 of the annular frame 66 by a slight shifting of the assemblies (a main body of a handbag and a handbag lid). Therefore, the rim-shaped projected-out portion 75 has an effect which facilitates engagement of the first and the second assemblies.

The embodiment of FIG. 8 is in substantial respect a combination of the embodiment of FIG. 6 and the embodiment of FIG. 7. More particularly, FIG. 8 shows an example in which a rim-shaped projected-out portion 75 is formed on the second assembly, and the magnet 22 is formed on the first assembly. Therefore, even though it is different from FIG. 6 and FIG. 7 in that it does not substantially protect or prevent destruction of a magnet card, it can effectively prevent mutual shifting in the horizontal direction between the first and the second assemblies. Further, the embodiment of FIG. 8 is similar to that of FIG. 7 in that it enables the first and the second assemblies to easily engage with each other. Also, in the embodiment of FIG. 8, when the annular frame is made of a magnetic material, an attracting force between the first and the second assemblies is increased by the rim-shaped projected out portion 75. Explaining this effect by example, an N pole on the upper portion of the magnet 22 and an S pole on the lower portion of the magnet 22 in FIG. 8 are assumed. As will be understood, the same effort as described for this example is obtained even if these poles are located in the opposite portions. Referring to the example polarity, magnetism from the upper N pole portion, as shown as the allowance C in the drawing, is led to the S pole side to be passed through the annular frame 66. At this time, since the rim-shaped projected-out portion 75 is installed in this example embodiment, the magnetism from the N pole portion is led to the top portion 75*a* of the rim-shaped projected-out portion 75, is propagated from the top portion 75*a* through the air and dropped outward and downward, passed through the annular plate 10 of the first assembly, and finally reaches the S pole side. By being installed on the projected projected portion 75, the flow of the magnetism from the N pole side effectively reaches both the first and the second assemblies and accordingly, stronger magnetic force between these assemblies is generated. Therefore, by installing the rim-shaped projected-out portion 75, the attractive force between the first and the second assemblies is increased.

In addition, the rim-shaped projected-out portion 75 strengthens the annular frame 66. More particularly, the rim-shaped projected-out portion 75 increases the strength of the annular frame 66 with respect to resistance to twisting. Since the annular frame is formed from a relatively thin plate, such an effect is very important. As described above, inclusion of the rim-shaped projected-out portion 75 produces considerable functional benefit effects.

Figure 9:
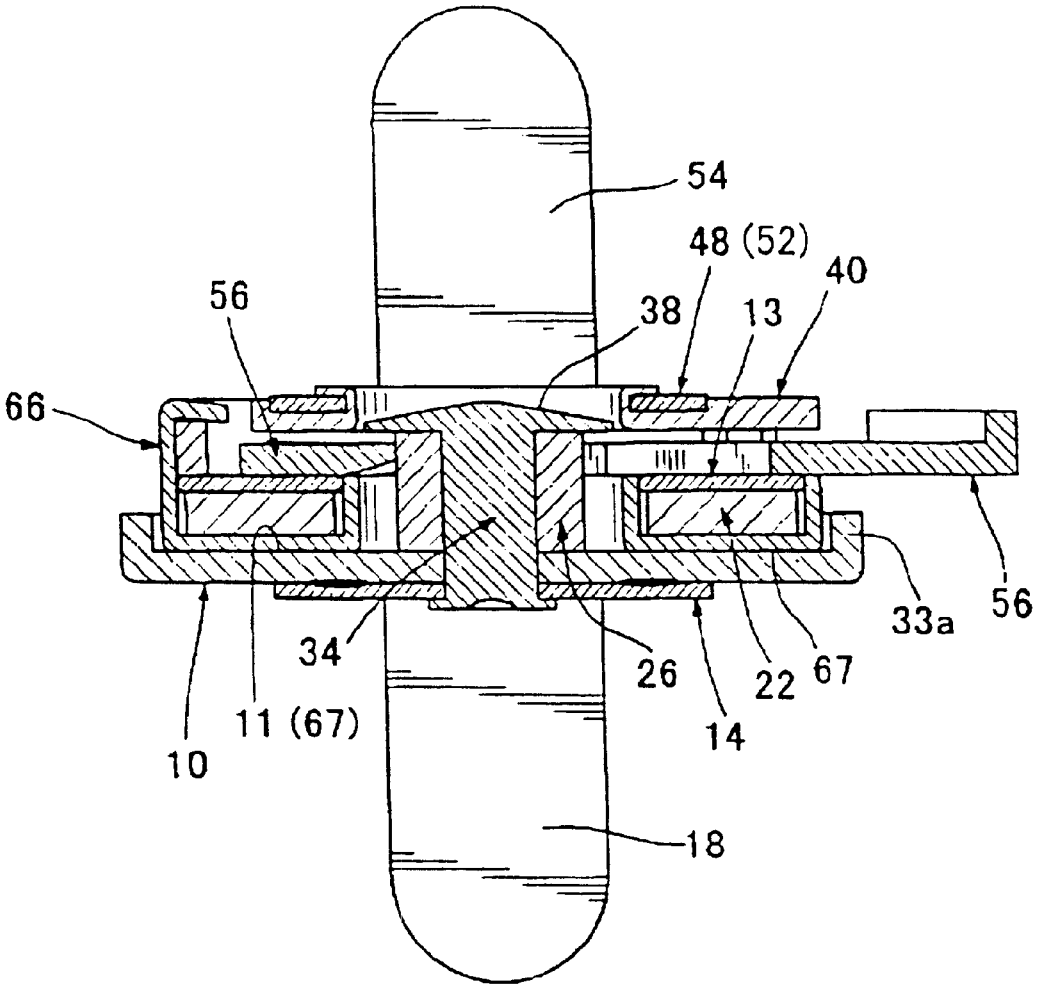
FIG. 9 shows a still further embodiment of the rim-shaped guide of the magnetic fixing unit of the present invention.

The embodiment in FIG. 9, in contrast to the embodiment in FIG. 8, shows an example in which a rim-shaped projected-out portion 33*a* is formed on the first assembly, and the magnet 22 is formed on the second assembly. (FIG. 9 uses like labeling as FIG. 8 for like structure.) Even in this reversed arrangement, a similar effect as described above for FIG. 8 is obtained.

Figure 10:
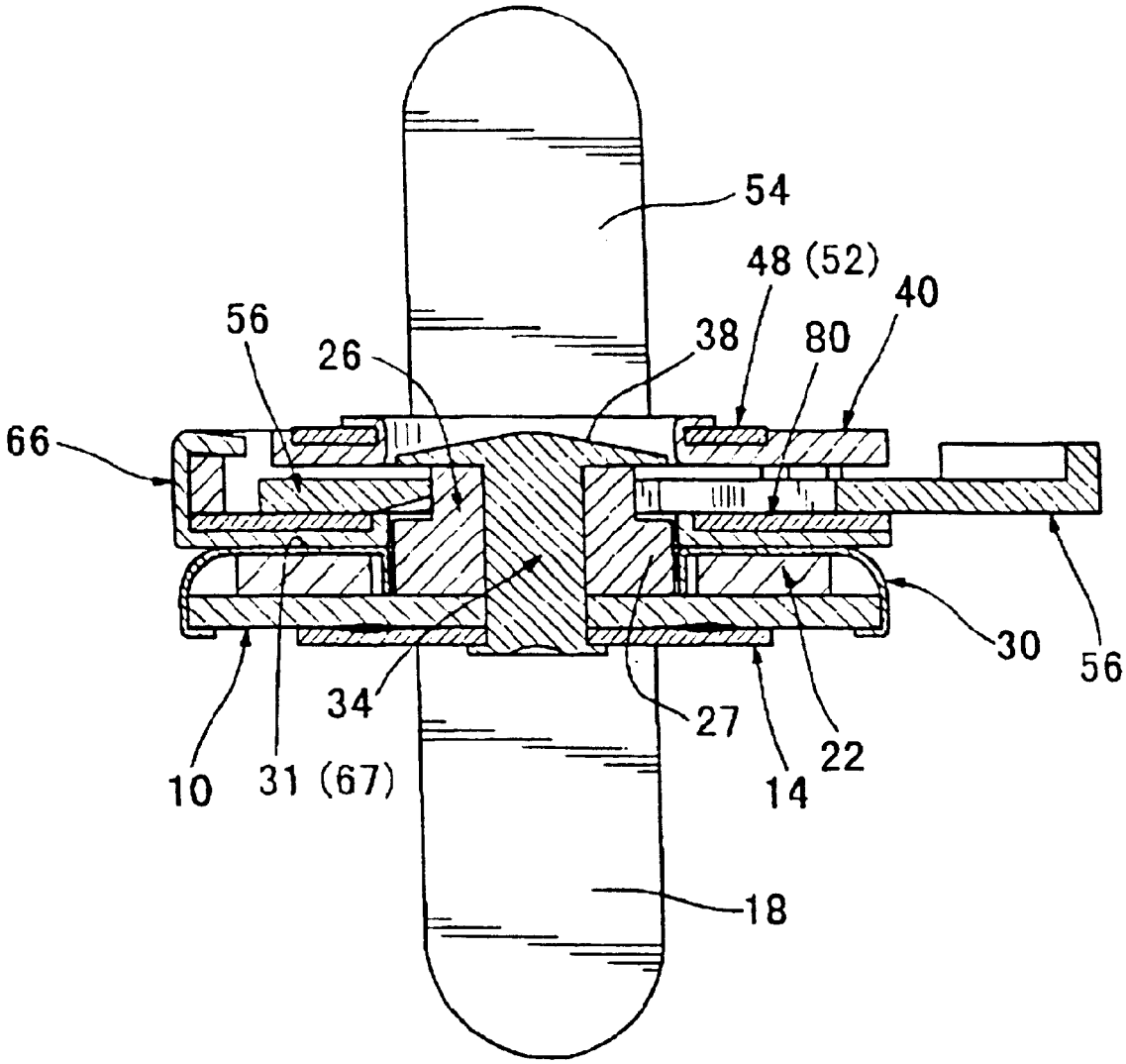
FIG. 10 shows an example embodiment of the extending guide portion of the magnetic fixing unit of the present invention.

FIG. 10 depicts another embodiment for preventing mutual shifting in a horizontal direction between the first and the second assemblies, similar to the effect achieved by the embodiments of FIG. 6 to FIG. 9. More particularly, the embodiment of FIG. 10 is an example in which an annular extending guide portion 27 is formed on the first assembly, in particular, at a lower portion of the cylindrical sleeve 26. An outer diameter of the extending guide portion 27, in particular, the outer diameter in a direction normal to the axis of engagement of the first and the second assemblies, has substantially the same size as that of the tip of the engaging portion 38 but larger than the cylindrical sleeve 26. Corresponding to the extending guide portion 27, the outer diameter of the hole of the second assemblies, in particular, the outer diameter at a location near an entrance to the hole, is formed substantially larger than that of the engaging head 38 or the extending guide portion 27.

Upon and after the first and the second assemblies are engaged with each other, the extending guide portion 27 of the first assembly is inserted near the entrance of the hole of the second assembly, and thereby effectively prevents the horizontal mutual shifting between these assemblies. The outer diameter of the lower portion of the cylindrical sleeve 26 need not be the same as the outer diameter of the engaging head 38; if it is made larger than the engaging portion 38, a similar effect as that described above is produced. For example, although not particularly shown in the drawing, if the cylindrical sleeve has a conical shape, where the diameter of its larger end is made substantially the same or larger than the engaging head 38, a similar effect as that described above will be produced. Further, the extending guide portion 27 need not be annular shaped and, instead, may be square shaped, pole shaped, or otherwise shaped.

Figure 11:
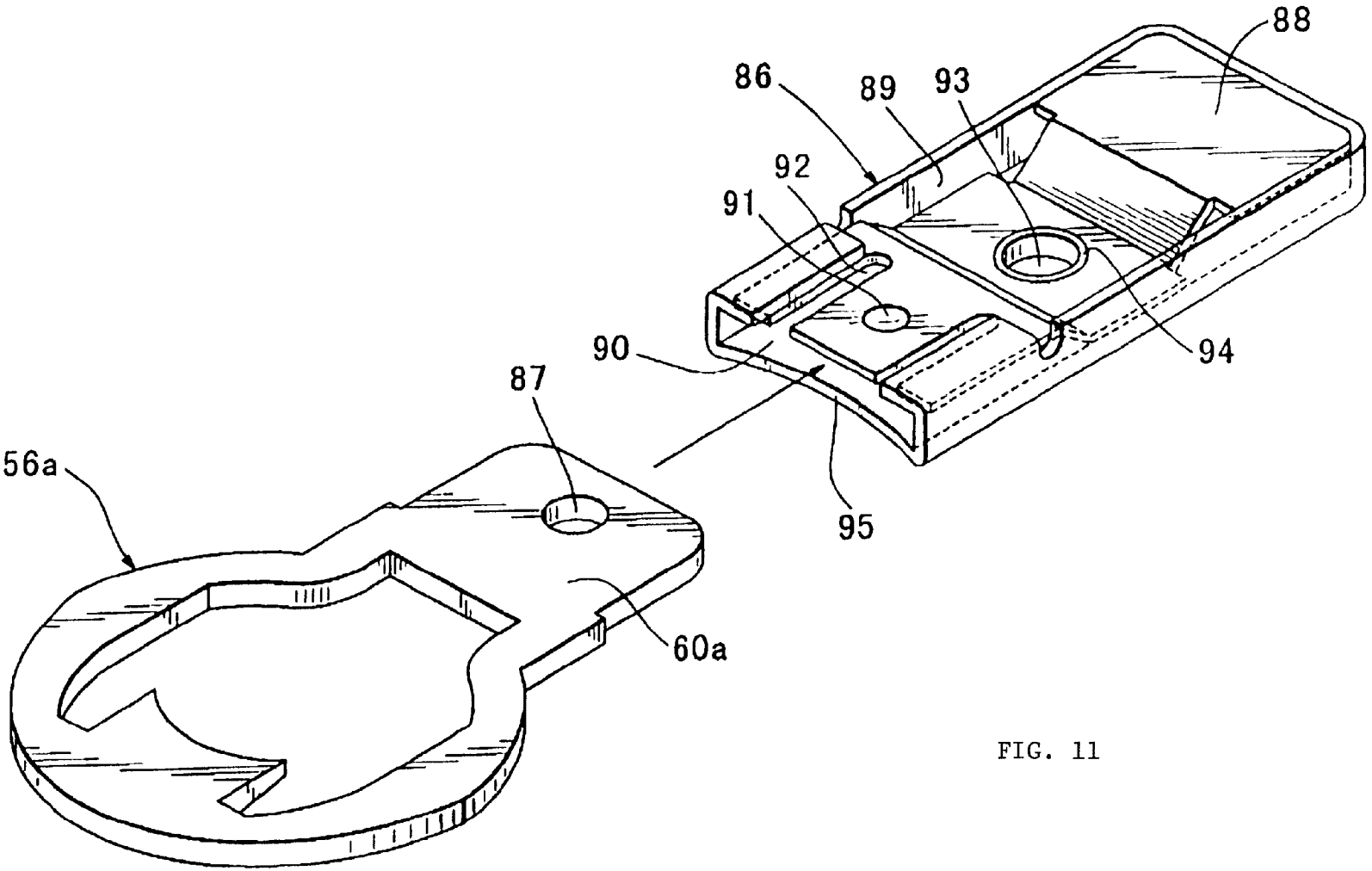
FIG. 11 shows another example embodiment of the slider of the magnetic fixing unit of the present invention.

Finally, with reference to FIG. 11, another embodiment of the slider 56, FIGS. 1 through 5 will be described. The slider 56*a* shown in FIG. 11 and the slider 56 described above with reference to FIG. 1 to FIG. 5 have the same shape except for the lever portion 60*a* of FIG. 11 which connects to the slider 56*a*. Further, the tongue portion of the FIG. 1 embodiment is omitted from the lever portion 60*a* of the slider 56*a*. Instead, a hole to install an extending member 86 is formed. The lever portion 60*a* of the slider 56*a* can be substantially extended by installing the extending member 86 on the slider 56*a*. The extending member 86 passes, for example, through a clearance between a main body of a handbag (not shown) and a handbag lid, which is necessary if it is installed at a deeper location than that of the edge 7 of the lid 3. As described previously, the lock between the first and the second assemblies is released by inserting a finger into the clearance and pushing the lever portion of the second assembly. Therefore, the release operation will be difficult or impossible if the second assembly is located at a deeper position.

The extending member 86 comprises two sheet metal parts, namely an inner plate 88 and an outer plate 89. The sheet metal parts 88 and 89 are respectively formed by penetrating, pressing, and bending of thin metal plate, and then fixed together as described in the drawing. In the fixing process, a center hole 93 of the inner plate 88 receives the projected portion 94, which goes toward inside of the outer plate. The two sheet metal parts are then caulked together. Other methods of fixing the parts, such as solder, waxing, or spot welding may be substituted. Referring to FIG. 11, although the end portion of the outer plate is slightly cut off inward by an arc 95, it is merely adjusted to the outer periphery of the of the annular frame 66 and the other shape may be applied. Particular note should be made of the top portion of the extending member 86 corresponding to the portion connecting to the slider 56*a*. An opening 90 to receive the lever portion 60*a* of the slider 56*a* is formed there. The size of the opening 90 is large enough to receive the lever portion of the slider 56. The slider 56*a* is fixed on the top portion by inserting the lever portion 60*a* into the opening 90, and is taken off from there by pulling the lever portion 60*a* from the opening 90. However, the slider 56*a* may remain in the fixed condition.

A projection which is made by outer pressure is formed near top center of the inner plate 88, and this projection forms a part of the opening 90. In the example of FIG. 11, it is not shown as a projection, but as a hollow portion. When the extending member 86 is fixed on the slider 56*a*, the projection 91 is closed coined) by the hole 87 which is formed on the portion corresponding to the slider 56. The top center portion of the inner plate 88 where the projection 91 is formed may be made to have an elastic displacement by forming a cut 92 on both sides. By the operation of the displacement, the projection 91 of the inner plate 88 is fixed on the hole 87 of the slider 56*a* with predetermined force and is also taken off from the hole 87. To effect better installation and removal of the extending member 86, the inner plate 88 can be made of phosphorus bronze. However, iron, or another metal, or a nonmetallic material such as plastic may also be used for the inner plate 88. Though the material of the outer plate 89 is not particularly limited, to obtain higher strength, both the inner plate 88 and the outer plate 89 are preferably made of metal (brass, iron or the other material).

This invention has been described in reference to specific example embodiments. It should be readily understood that many variations and arrangements, which are within the spirit and scope of the described invention will be seen by one of ordinary skill upon reading the present description. These variations and arrangements are suggested by this description and are within the scope of the appended claims.

What is claimed is:

1. A magnetic fixing unit comprising:

a first magnet;

a first housing assembly formed around said first magnet and having a projection extending in a first axis, said projection having an abutment surface at an angle to said first axis;

a second housing assembly having a front face, a back face, a receptacle extending from an opening on said front face toward said back face, and an outer surface extending from said front face to said back face, said receptacle dimensioned to accommodate said projection, said receptacle extending in a second axis, said second housing assembly having a channel opening on said outer surface and a passage opening into said receptacle;

a slide member arranged with a manual actuation portion extending through and movable in said channel, having at least a portion made of a material attracted by a magnetic force, and having an abutment stop, wherein said first magnet, said projection, said abutment surface, said channel, said passage and said slide member are arranged such that when said projection is inserted into said receptacle a magnetic force from said first magnet urges slide member in a first direction within said channel such that said abutment stop extends into said passage and said abutment and said abutment stop prevent said projection from being withdrawn, and when a manual force is applied to said manual actuation portion in a direction opposite said first direction said slide member moves said abutment out of said passage away from said projection thereby releasing said projection from said receptacle, and wherein said first housing assembly includes:

a fixing member for attaching to an external fabric or leather, having a support plate with a top surface and a back surface and a plurality of prongs extending away from said back surface;

an annular plate secured to said top of surface of said fixing member;

a cylindrical magnet arranged on said annular plate having a center through hole;

a cylindrical sleeve arranged within said center through hole of said cylindrical magnet; and a top housing plate having a center clearance hole, arranged over said tope surface of annular plate, said cylindrical magnet and said cylindrical sleeve, and fixed to said annular plate, wherein said projection includes a stem extending through said center clearance hole and into a center of said cylindrical member.

2. A magnetic fixing unit comprising:

a first magnet;

a first housing assembly formed around said first magnet and having a projection extending in a first axis, said projection having an abutment surface at an angle to said first axis;

a second housing assembly having a front face, a back face, a receptacle extending from an opening on said front face toward said back face, and an outer surface extending from said front face to said back face, said receptacle dimensioned to accommodate said projection, said receptacle extending in a second axis, said second housing assembly having a channel opening on said outer surface and a passage opening into said receptacle;

a slide member arranged with a manual actuation portion extending through and movable in said channel, having at least a portion made of a material attracted by a magnetic force, and having an abutment stop, wherein said first magnet, said projection, said abutment surface, said channel, said passage and said slide member are arranged such that when said projection is inserted into said receptacle a magnetic force from said first magnet urges slide member in a first direction within said channel such that said abutment stop extends into said passage and said abutment and said abutment stop prevent said projection from being withdrawn, and when a manual force is applied to said manual actuation portion in a direction opposite said first direction said slide member moves said abutment out of said passage away from said projection thereby releasing said projection from said receptacle, wherein said slide member includes a flat plate having a center clearance hole and an outer periphery having a substantially circular shape aligned substantially concentric with said center clearance hole and said lever includes a structure extending outward from said outer periphery, wherein said abutment stop includes a structure extending into said center clearance hole.

3. A magnetic fixing unit according to claim 2 wherein said channel and said passage are substantially collinear and wherein said slide member lever structure extending outward from said outer periphery extends substantially collinear with said abutment stop structure extending into said center clearance hole.

4. A magnetic fixing unit according to claim 3 wherein said second housing assembly includes:

a second housing base plate; and a second housing upper plate having an upper mating surface extending in a plane substantially normal to said second axis, and a center clearance hole opening in the plane of said upper mating surface and a substantially cylindrical inner structure surrounding said center clearance hole, extending in the direction of said second axis and having a first cut-away section, outer attachment structure surrounding said upper mating surface and having a second cut-away extending substantially parallel to said upper mating surface, and wherein said second housing upper plate is attached to said second housing base plate with said slide member arranged between said second housing base plate and said second housing upper plate, said receptacle includes said substantially cylindrical inner structure, said channel includes said upper housing plate first cut-away, and said passage includes said upper housing plate second cut-away.

* * * * *

UNITED STATES PATENT AND TRADEMARK OFFICE

CERTIFICATE OF CORRECTION

PATENT NO. : 6,564,434 B1
DATED : May 20, 2003
INVENTOR(S) : Tamao Morita

It is certified that error appears in the above-identified patent and that said Letters Patent is hereby corrected as shown below:

Column 1,
Line 2, after the title, please add:
-- Applicant under the provisions of 35 U.S.C. § 119, hereby claims the benefit of Japanese Application No. 11-250400 filed September 3, 1999. --

Signed and Sealed this

First Day of June, 2004

JON W. DUDAS
*Acting Director of the United States Patent and Trademark Office*